US009945105B2

(12) United States Patent
Ye et al.

(10) Patent No.: US 9,945,105 B2
(45) Date of Patent: Apr. 17, 2018

(54) DRAIN PLUG LINKAGE DEVICE

(71) Applicant: Xiamen Lota International Co., Ltd., Fujian (CN)

(72) Inventors: Liming Ye, Fujian (CN); Jianping Zhou, Fujian (CN); Yan Zhang, Fujian (CN)

(73) Assignee: XIAMEN LOTA INTERNATIONAL CO., LTD., Fujian (CN)

( * ) Notice: Subject to any disclaimer, the term of this patent is extended or adjusted under 35 U.S.C. 154(b) by 618 days.

(21) Appl. No.: 14/246,684

(22) Filed: Apr. 7, 2014

(65) Prior Publication Data

US 2014/0310864 A1 Oct. 23, 2014

(30) Foreign Application Priority Data

Apr. 17, 2013 (CN) ..... 2013 1 0134232

(51) Int. Cl.
*E03C 1/23* (2006.01)

(52) U.S. Cl.
CPC ..... *E03C 1/2302* (2013.01)

(58) Field of Classification Search
CPC ..... E03C 1/232; E03C 1/2302; A47K 1/14
USPC ..... 4/295, 678, 689–693
See application file for complete search history.

(56) References Cited

U.S. PATENT DOCUMENTS 1,597,459 A * 8/1926 Muend ..... E03C 1/23 4/691
3,125,764 A * 3/1964 Young ..... E03C 1/23 24/115 R
4,218,785 A * 8/1980 Crawford ..... E03C 1/232 4/295
4,903,943 A 2/1990 Hochstrasser
5,255,993 A * 10/1993 Kovacs ..... F16B 7/042 403/316
6,023,795 A * 2/2000 Potter ..... E03C 1/23 251/231
6,061,847 A 5/2000 Jourdan
6,386,786 B1 * 5/2002 Perlman ..... F16B 7/04 248/540

(Continued)

FOREIGN PATENT DOCUMENTS

DE 2946073 A1 * 5/1981 ..... E03C 1/23

*Primary Examiner* — Tuan N Nguyen
*Assistant Examiner* — William R Klotz
(74) *Attorney, Agent, or Firm* — Cantor Colburn LLP

(57) ABSTRACT

In the invention a drain plug linkage device (100) is provided, comprising: a drain plug (4) at least partially disposed in a pipe body (5); a pull rod assembly including a pull rod, a link rod (2) and a pull rod connector (9), wherein the link rod (2) at its upper end comprises a receiving portion, the pull rod connector (9) comprises a central hole and adapted to be snapped into the containing portion, and the pull rod at its bottom comprises a snap portion adapted to be snapped into the central hole; and a lever member (3) comprising a first end operatively connected to the link rod (2), and a second end extending into the pipe body (5) and configured to operate the drain plug (4); wherein the receiving portion comprises an expansion portion (22) for expanding the central hole, and the pull rod connector (9) is configured, when snapped into the receiving part, to be movable between a position where the central hole is unexpanded and a position where the central hole is expanded by the expansion portion (22).

20 Claims, 25 Drawing Sheets

(56) References Cited

U.S. PATENT DOCUMENTS

| | | | | |
|---|---|---|---|---|
| 7,241,071 | B2 * | 7/2007 | Carraher | E04C 5/163 403/164 |
| 8,079,098 | B2 * | 12/2011 | Thomas | E03C 1/23 137/801 |
| 8,136,179 | B2 * | 3/2012 | Li | E03C 1/23 4/689 |
| 9,186,179 | B2 * | 11/2015 | Mullaney | A61B 17/6466 |
| 2003/0149429 | A1 * | 8/2003 | Ferrante | A61B 17/645 606/59 |
| 2012/0060274 | A1 * | 3/2012 | Duncan | E03C 1/2302 4/679 |

* cited by examiner

Section G-G

681

681

67
68
681

67
681

682
69

63

63

33
Section I-I

33
I
I

31

33
34

31

DRAIN PLUG LINKAGE DEVICE

CROSS REFERENCE TO RELATED APPLICATIONS

This application claims priority under 35 U.S.C. §119 to following Chinese Patent application no. CN 201310134232.1, filed Apr. 17, 2013, the contents of which are incorporated herein by reference thereto.

FIELD OF THE INVENTION

The present invention relates particularly to the technical field of drain, a drain device for example for bathroom, tub, washbasin or hand-washing sink, and more particularly to a drain plug linkage device which can be assembled and adjusted rapidly.

BACKGROUND OF THE INVENTION

A water discharger, also referred to as drain device, is proposed for storing or discharging water in containers such as bathroom, tub, washbasin or hand-washing sink. Such drain device is generally in form of a drain plug linkage device. For instance, in a prior art drain device, the container is in communication with a drainpipe through an outlet, and a drain plug is disposed adjacent to the outlet and connected with one end of an operating rod such as a lever member, and the other end of the lever member is connected with a pull rod member extending downwards, so as to move the drain plug between positions of closing and opening the outlet by operating the pull rod member, realizing water storage or discharge in the containers like bathroom pool, tub, washbasin or hand-washing sink.

A number of the drain devices, namely drain plug linkage devices, have been known in the prior art.

For example, U.S. Pat. No. 4,903,943 discloses a linkage mechanism for a discharge valve, in which a spherical part is fixed on a lever member such that the lever member can perform a lever motion about the spherical part as a pivot point. The lever member is connected at one end with a pull rod member via a connecting member, and at the other end with a drain plug, while the connecting member at one end is pivotally and undetachably connected with the lever member by means of a pin, and at the other end is secured to a position of the pull rod member by means of a screw, such that an operative connection between the pull rod member and lever member is realized, so as to perform opening or closing movement of the drain plug by pulling the pull rod member upwards or downwards. It is fairly difficult to assemble such a linkage mechanism, since a number of small components have to be mounted in a limited space. Furthermore, the connecting member is prone to rust, which will be detrimental to operation of the linkage mechanism. Moreover, the pull rod member of the linkage mechanism is mainly made from rigid rod pieces, which results in lack of degree of freedom during transition from a vertical lift movement of the pull rod to a vertical lift movement of the drain plug via the lever action. In addition, difficulty occurs in mounting a locking nut by means of which the spherical part is directly and pivotably mounted in the pipe body of the discharge valve.

U.S. Pat. No. 6,061,847 discloses a linkage assembly for a drain stopper, including an elongated connector bar having a plurality of apertures at both its upper and lower ends, a stem having a J-shaped portion, a lever arm, and a drain stopper having an aperture, wherein the J-shaped portion of the stem is received within a select aperture at the upper end of the connector bar, and the lever arm at one end is inserted in a select aperture at the lower end of the connector bar, and at the other end is inserted in the aperture of the drain stopper. The linkage assembly is operated with a higher degree of freedom and assembled more easily, as compared with that of U.S. Pat. No. 4,903,943. However, no positioning effect can be provided by the connection among the J-shaped portion of stem, the apertures of connector bar and the lever arm in the linkage assembly, such that an effective opening and closing movement of the drain stopper may not be realized by said linkage assembly.

U.S. Pat. No. 8,136,179 B2 discloses a drain stopper linkage assembly, including a lift rod, a connecting bar, a pivot rod and a drain stopper, wherein the bottom end of the lift rod forms an engagement part, the upper end of the connecting bar has an engagement groove for the engagement part of the lift rod being engaged and fixed, the connecting bar has a plurality of holes, the pivot rod at one end has concave arc fixed portions for tying in with the hole, and a convex arc portion disposed between two said fixed portions, and an outer diameter of the pivot rod adjacent the end is slightly larger than an inside diameter of the holes of the connecting bar. In the drain stopper linkage assembly, the connecting bar is connected with the lift rod and the pivot rod both in form of snapping, which improves accuracy of positioning. Nevertheless, a considerable force for disengaging the snapping connection needs to be overcome, which results in, e.g., difficulty in adjusting the positions of the connecting bar relative to the pivot rod and also in disengaging the lift rod from the connecting bar, meanwhile causes wear of components in the linkage assembly easily, and shortens service life of the linkage assembly. Moreover, a spherical body of the pivot rod in the linkage assembly is still directly mounted in a pipe via a locking nut, causing difficulty in assembly in the limited space.

Therefore, there is need to improve the prior drain plug linkage devices, with advantages of simple and reliable assembly and disassembly, easy adjustment and reliable operation of the drain plug linkage device.

SUMMARY OF THE INVENTION

It is thus the object of the present invention to provide a drain plug linkage device which can solve at least some of the aforesaid technical problems.

According to an aspect of the present invention, a drain plug linkage device is provided, comprising: a drain plug at least partially disposed in a pipe body; a pull rod assembly including a pull rod, a link rod and a pull rod connector, wherein the link rod at its upper end has a receiving portion, the pull rod connector comprises a central hole and is adapted to be snapped into the receiving portion, and the pull rod at its bottom comprises a snap portion adapted to be snapped into the central hole; and a lever member comprising a first end operatively connected to the link rod, and a second end extending into the pipe body and configured to operate the drain plug; wherein the receiving portion comprising an expansion portion for expanding the central hole, and the pull rod connector is configured, when snapped into the receiving portion, to be movable between a position where the central hole is unexpanded and a position where the central hole is expanded by the expansion portion.

In the drain plug linkage device, the pull rod can be mounted to the link rod in a simple and reliable way. Dismantling of the pull rod is also very simple and causes low damage. For example, the pull rod can be easily withdrawn by means of pressing the pull rod connector to engage the expansion portion which in turn expands the central hole of the pull rod connector.

In a specific embodiment, the receiving portion is in form of a receptacle comprising an inwardly-extending circumferential flange for snapping the pull rod connector.

In a preferred embodiment, the pull rod connector comprises a top flange, and a pair of oppositely disposed and spaced flexible deformation portions extending from the top flange. Preferably, the expansion portion may be in form of a protruding feature formed in the receptacle, such that the flexible deformation portions can be conveniently expanded by the protruding expansion portion.

Preferably, to facilitate the expansion by means of the expansion portion, a guiding slope is formed at bottom side of the pair of flexible deformation portions, and the expansion portion comprises a taper section corresponding to the guiding slope.

In a particularly preferred embodiment, the flexible deformation portions comprises an outwardly-extending circumferential flange, and the circumferential flange of the receptacle has an inner diameter smaller than outer diameter of the circumferential flange of the flexible deformation portions and is disposed between the top flange and the circumferential flange of flexible deformation portions. More preferably, the distance between the top flange and the circumferential flange of the flexible deformation portions is provided in such a manner that when the pull rod connector is moved downwards to engage with the circumferential flange of the receptacle, the central hole of the pull rod connector is expanded by the expansion portion to the extent that is larger than a maximum outer diameter of the snap portion of pull rod connector.

Preferably, the receptacle comprises a lateral guiding slope for fitting the circumferential flange of the pull rod connector.

In a preferred embodiment, the central hole comprises a large diameter section and a small diameter section, and the snap portion comprises a ring groove adapted to be snapped in the small diameter section and a tip defined by the ring groove.

More preferably, a guiding slope is formed between the large diameter section and small diameter section, and the tip comprises a tip taper section.

In another particularly preferred embodiment, the pipe body comprises a receiving port, and the drain plug linkage device further comprises a pivot assembly disposed in the receiving port, and a fastening mechanism for fastening the pivot assembly in the receiving port, the pivot assembly comprising a sleeve means, and a spherical portion pivotably arranged in the sleeve means and mounted to the lever member between the first and second ends of the lever member.

Preferably, the sleeve means comprises a pivot sleeve and a support washer engaging with the spherical portion as well as a fastening sleeve for fastening the pivot sleeve and the support washer together.

In a further preferred embodiment, the receiving port comprises a circumferential cut-out, and the fastening mechanism is in form of a snapping member comprising an arc-shaped snapping segment snapped and fixed in the circumferential cut-out and having an arc shape greater than or equal to a semicircle.

Preferably, the circumferential cut-out and/or the arc-shaped snapping segment at a snapped position have an interference fit point.

More preferably, the pipe body is provided with a pivot, and the snapping member comprises an arc-shaped pivoting segment pivotally mounted on the pivot.

According to another aspect, a drain plug linkage device is provided, comprising: a drain plug at least partially disposed in a pipe body; a pull rod assembly including a link rod; a lever member comprising a first end operatively connected with the link rod, and a second end extending into the pipe body and configured to operate the drain plug; and an adjustment mechanism for operatively connecting the lever member to the link rod; wherein the lever member has a plurality of first adjustment positions, the link rod has a plurality of second adjustment positions, and the adjustment mechanism is configured to be engaged into one of the plurality of first adjustment positions and also one of the plurality of second adjustment positions.

In the drain plug linkage device, the lever member and the link rod are not mutually adjusted, but independently from each other, such that it is easy to achieve simple assembly and disassembly as well as relative position adjustment of the lever member and link rod.

In a specific embodiment, the adjustment mechanism comprises: a first adjustment slider disposed over the lever member; a second adjustment slider disposed over the link rod and connected with the first adjustment slider; a first adjustment button inserted into the first adjustment slider and having a first engagement portion for engaging into the first adjustment position; and a second adjustment button inserted into the second adjustment slider and having a second engagement portion for engaging into the second adjustment position; wherein the first adjustment slider comprises a first biasing portion configured to bias the first engagement portion to engage into the first adjustment position, the second adjustment slider comprises a second biasing portion configured to bias the second engagement portion to engage into the second adjustment position. In the drain plug linkage device of the present invention, the relative positions of the lever member and link rod thus can be easily and conveniently adjusted with a very low adjustment force, e.g. by simply overcoming the biasing force of the bias portion.

In a particularly preferred embodiment, the lever member comprises a plurality of grooves and/or through-holes, at least one of the grooves and/or through-holes defines one of the first adjustment positions, and the first adjustment button comprises a first press portion integrated or connected with the first engagement portion and comprising a ledge in contact with the first biasing portion, wherein the first engagement portion comprises a protrusion arranged oppositely to the first press portion and configured to be engageable into the groove and/or through-hole.

In another particularly preferred embodiment, the link rod comprises a plurality of grooves and/or through-holes, at least one of the grooves and/or through-holes of the link rod defining one of the second adjustment positions, and the second adjustment button comprises a second press portion integrated or connected with the second engagement portion and comprising a ledge in contact with the second biasing portion, wherein the second engagement portion comprises a protrusion arranged oppositely to the second press portion and configured to be engageable into the groove and/or through-hole of the link rod.

In a preferred embodiment, the adjustment mechanism further comprises a pin inserted into the first and second sliders, and a clamping member for securing the pin.

According to yet another aspect, a drain plug linkage device is provided, comprising: a drain plug at least partially disposed in a pipe body, wherein the pipe body comprising a receiving port; a pull rod assembly; a lever member having a first end operatively connected with the pull rod assembly, and a second end extending into the pipe body and configured to operate the drain plug; a pivot assembly disposed in the receiving port, wherein the pivot assembly comprises a sleeve means, and a spherical portion pivotably arranged in the sleeve means and mounted to the lever member between the first and second ends of the lever member; and a fastening mechanism for fastening the pivot assembly in the receiving port.

In the drain plug linkage device of the present invention, it is not necessary to mount and support the spherical portion as the pivot point of the lever member by a locking nut in a limited space. Instead, the spherical portion and support structure thereof are provided in form of an assembly, so as to simply insert and hold the assembled pivot assembly simply in the receiving port of the pipe body. Therefore, to mount the sleeve assembly, various fastening means, such as snapping mechanism, which simplifies assembly and disassembly of the device, can be utilized.

In yet another aspect of the present invention, a method of assembling or disassembling the drain plug linkage device according to the present invention is provided.

The additional features and advantages of the present invention will partially become apparent to those skilled in the art upon reading the disclosure, and the others will be described in the following embodiments with reference to the accompanying drawings.

BRIEF DESCRIPTION OF THE DRAWINGS

The present invention will be further described with reference to the specific embodiments illustrated in the figures, in which.

DETAILED DESCRIPTION OF THE EMBODIMENTS

Figure 1:
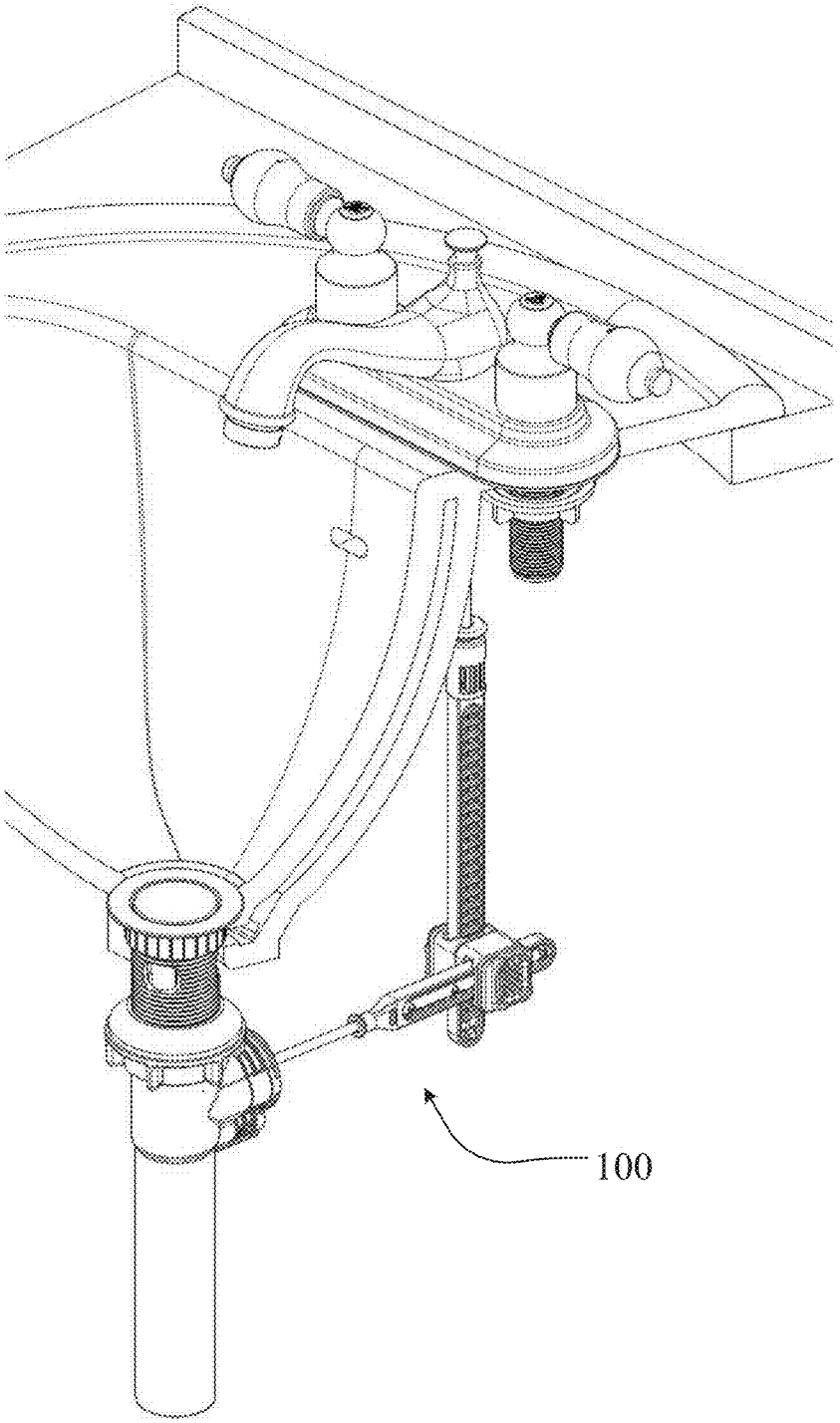
FIG. 1 shows a partially sectional perspective view of a washbasin suitable for use with a drain plug linkage device in accordance with an embodiment of the present invention.

For a better understanding of the features, objects and effects of the present invention, exemplary embodiments of the present invention will be described with reference to the figures. Although the figures are provided to represent some embodiments of the present invention, the drawings are not required to be drawn in scale, and some features can be enlarged, removed or cross-sectioned to better illustrate the present invention. The term "in the drawing" or similar terms used herein do not necessarily refer to all the accompanying drawings or examples.

Some directional terms, such as "top", "bottom", "left", "right", "upwards", "downwards" and other directional terms, used herein for describing the accompanying drawings will be understood to have their normal meaning and will refer to those directions as the drawings are normally viewed, and shall not be interpreted as a restriction to technical solutions in the appended claims.

The term "about" or "approximately" used herein will be understood by the person skilled in the art and will vary to some extent depending upon the context in which it is used.

Figure 2:
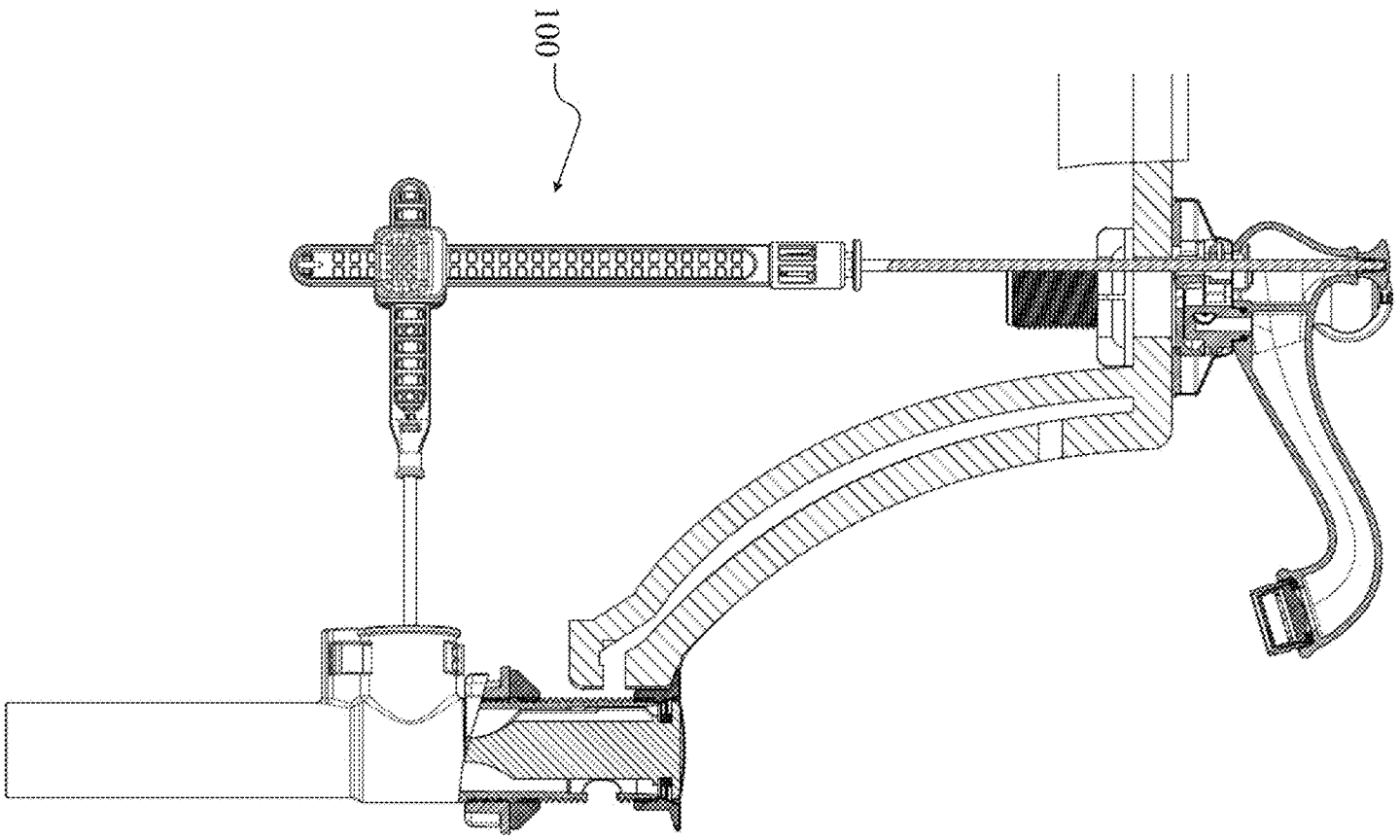
FIG. 2 shows a sectional view of the washbasin arrangement of FIG. 1.

FIGS. 1 and 2 show a household appliance, and particularly, a washbasin, as a container, and accessories thereof. Such a washbasin is generally equipped with a faucet, such as those being provided with a pair of faucet handles for dispensing cold water and hot water respectively, and a drain plug linkage device 100 (also known as a discharge device) according to an embodiment of the present invention, as illustrated in FIGS. 1 and 2. The drain plug linkage device 100 is applicable to the washbasin as illustrated, so as to be operated by a user to perform closing or opening movement of a drain plug disposed at a drain port of a drain pipe. Although the illustrated drain plug linkage device 100 is used n with the washbasin, it is conceivable to incorporate the linkage device into various containers, such as tubs, bathrooms, hand-washing basins or other household appliances, in which water storage and discharge is needed. It should be understood by the person skilled in the art that various applications incorporated with the drain plug linkage device of the present invention may be covered within the scope of the present invention. It would be not critical to the present invention in embodying various configurations of the washbasin and other containers, which can be arranged by the person skilled in the art as required and would not be detailed herein. The drain plug linkage device 100 of the present invention will be detailed below.

Referring to FIGS. 3 to 7, the drain plug linkage device 100 according to the present invention is generally shown, which mainly comprises a drain plug 4 (also usually known as "rocket") at least partially disposed in a pipe body 5, such as a drainpipe, and configured to open or close a port of the pipe body 5, a lever member 3, and a pull rod assembly 10. The lever member 3 has a first end 300 operatively connected with the pull rod assembly 10 via an adjustment mechanism 6 (as detailed below), and a second end 301 configured to operate opening and closing movement of the drain plug 4. In this embodiment, the second end 301 of the lever member 3 is inserted in an aperture 41 formed on the bottom of the drain plug 4. The aperture 41 has a size larger than the second end 301 of the lever member 3, such that the second end 301 and the aperture 41 loosely fit with each other, but it is still allow to perform opening and closing movement of the drain plug by means of the second end 301 when the lever member 3 acts a lever motion. It is also conceivable of other fitting forms between the second end 301 and the aperture 41. For example, the second end has the same size as the aperture 41, or is directly connected with a drain plug which does not have any aperture.

The pull rod assembly 10 according to the present invention will be described with reference to FIGS. 13, 21, 22 and 23A-H. In an embodiment, the pull rod assembly 10 comprises a pull rod 1, a link rod 2 and a pull rod connector 9. In the embodiment, as particularly shown in FIGS. 3 and 7, the link rod 2 is operatively connected with the lever member 3 via the adjustment mechanism 6. The pull rod connector 9 is disposed between the pull rod 1 at an upper position and the lower link rod 2 at a lower position, and is utilized for coupling the pull rod 1 with the link rod 2.

Figure 3:
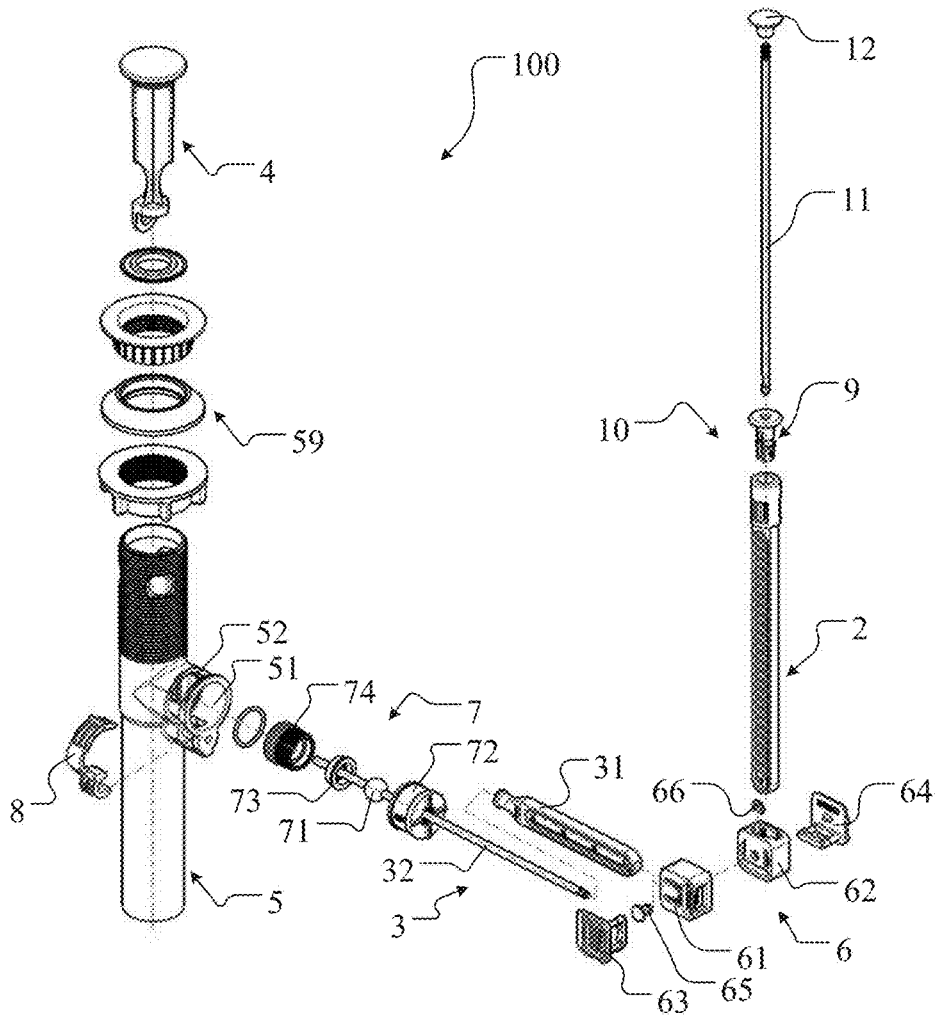
FIG. 3 shows a complete exploded view of a drain plug linkage device in accordance with an embodiment of the present invention.
Figure 13:
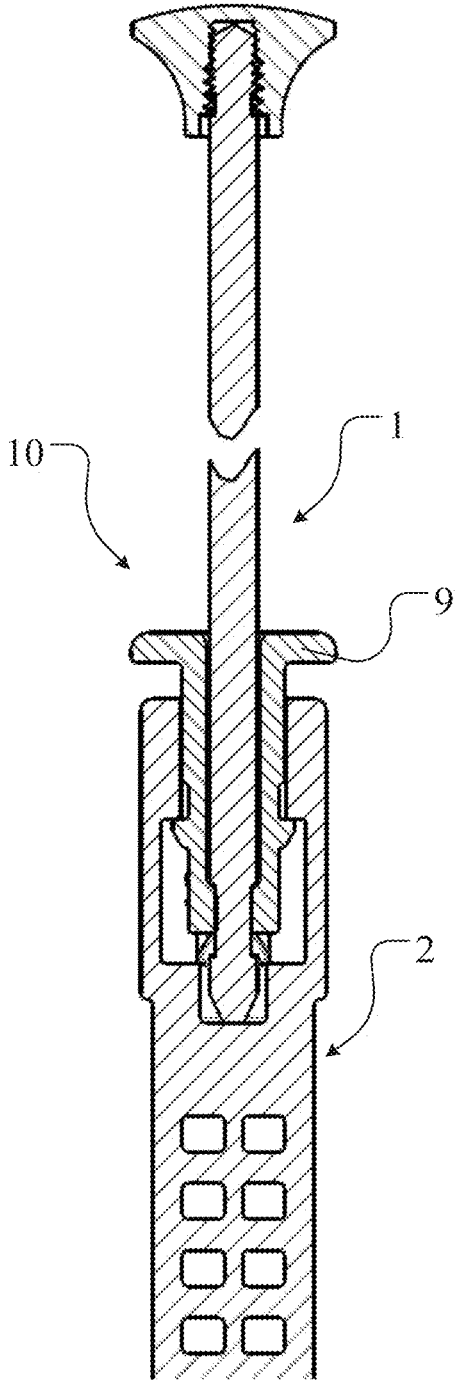
FIG. 13 shows a sectional view taken along the line D-D of FIG. 8.
Figure 22:
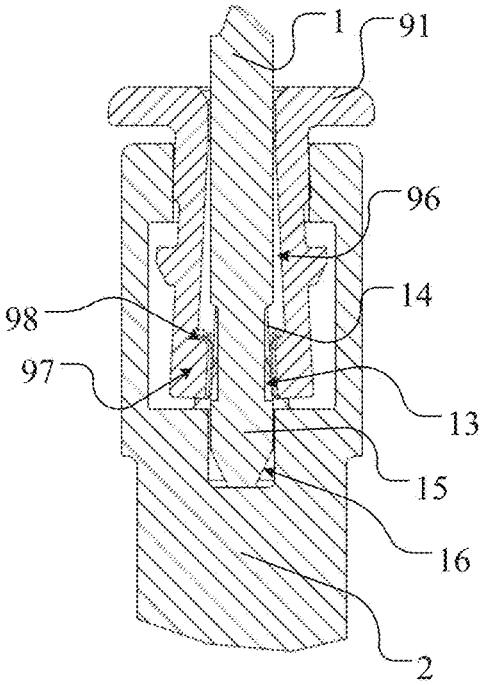
FIG. 22 shows a schematic view of expanding a central hole by an expansion portion for dismantling a pull rod.
Figure 23A:
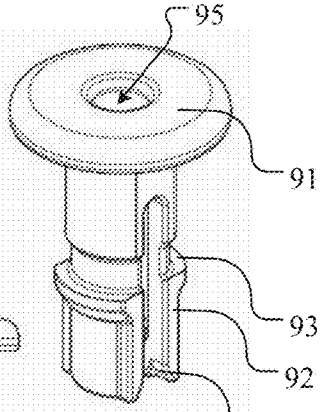
FIGS. 23A-H show views of a pull rod connector in accordance with an embodiment of the present invention.
Figure 23B:
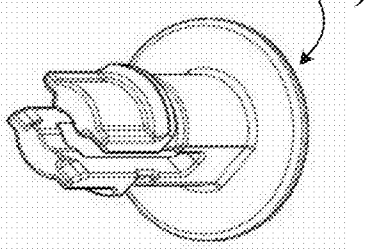
Figure 23D:
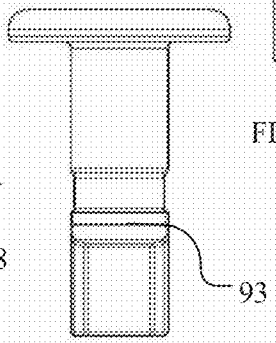
Figure 23F:
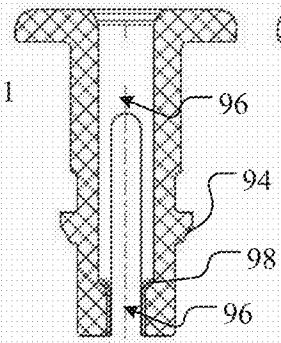
Figure 23G:
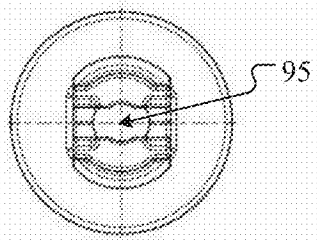
Figure 23C:
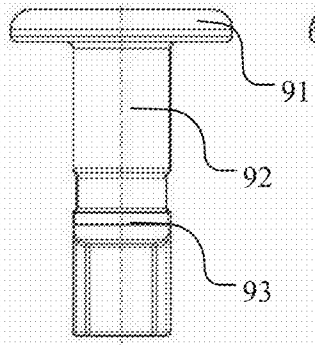
Figure 23H:
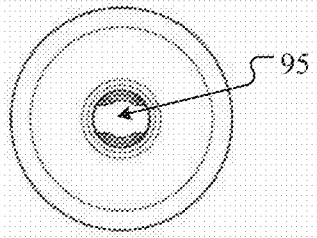
Figure 23E:
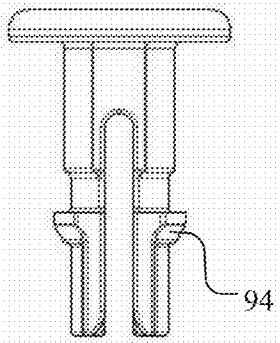
Figures 24A, 24B, 24C, 24D, 24E, 24F, 24G, 24H:
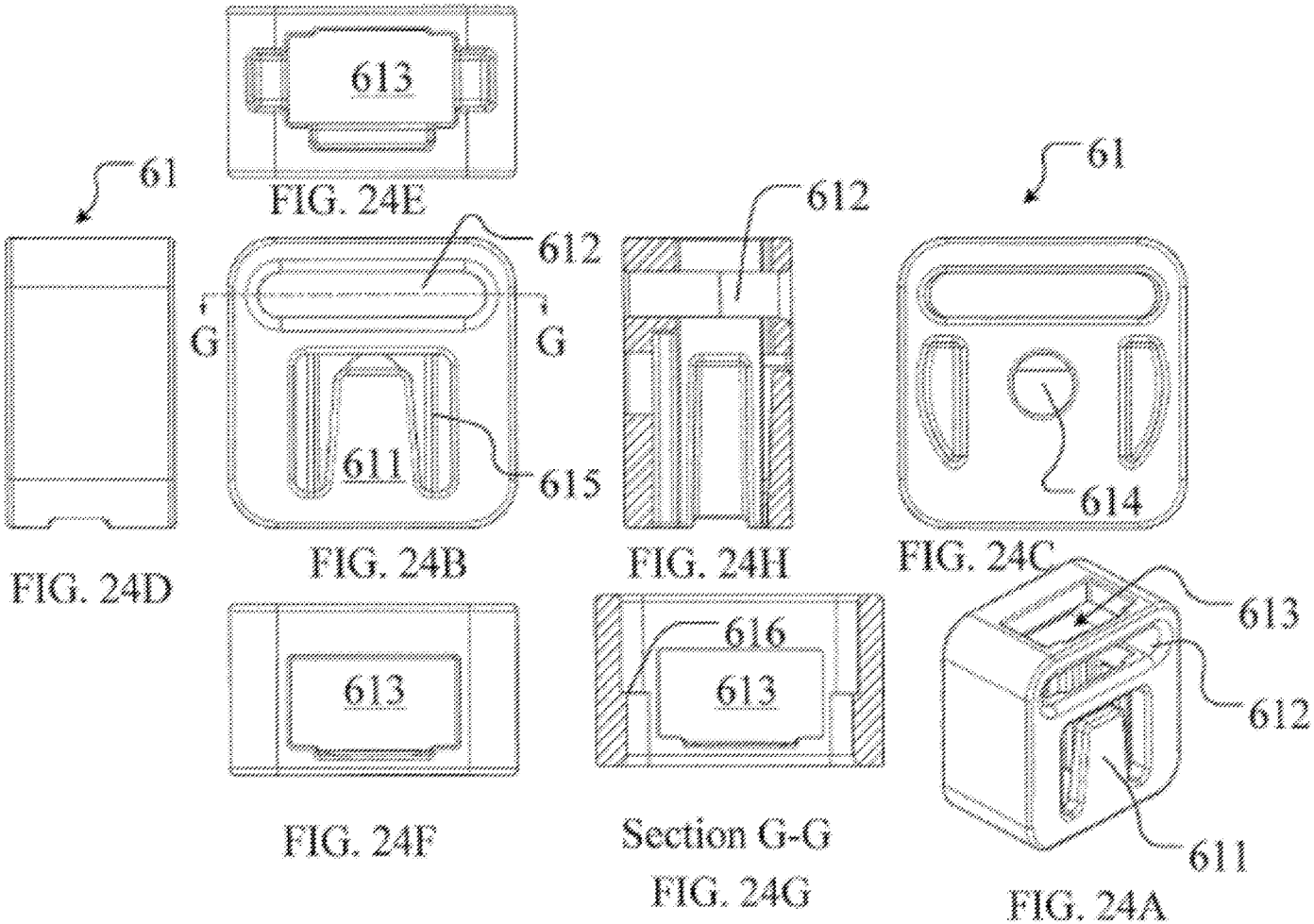
FIGS. 24A-H show views of an adjustment slider of the adjustment mechanism in accordance with an embodiment of the present invention.
Figures 25A, 25B, 25C, 25D, 25E, 25F, 25G, 25H:
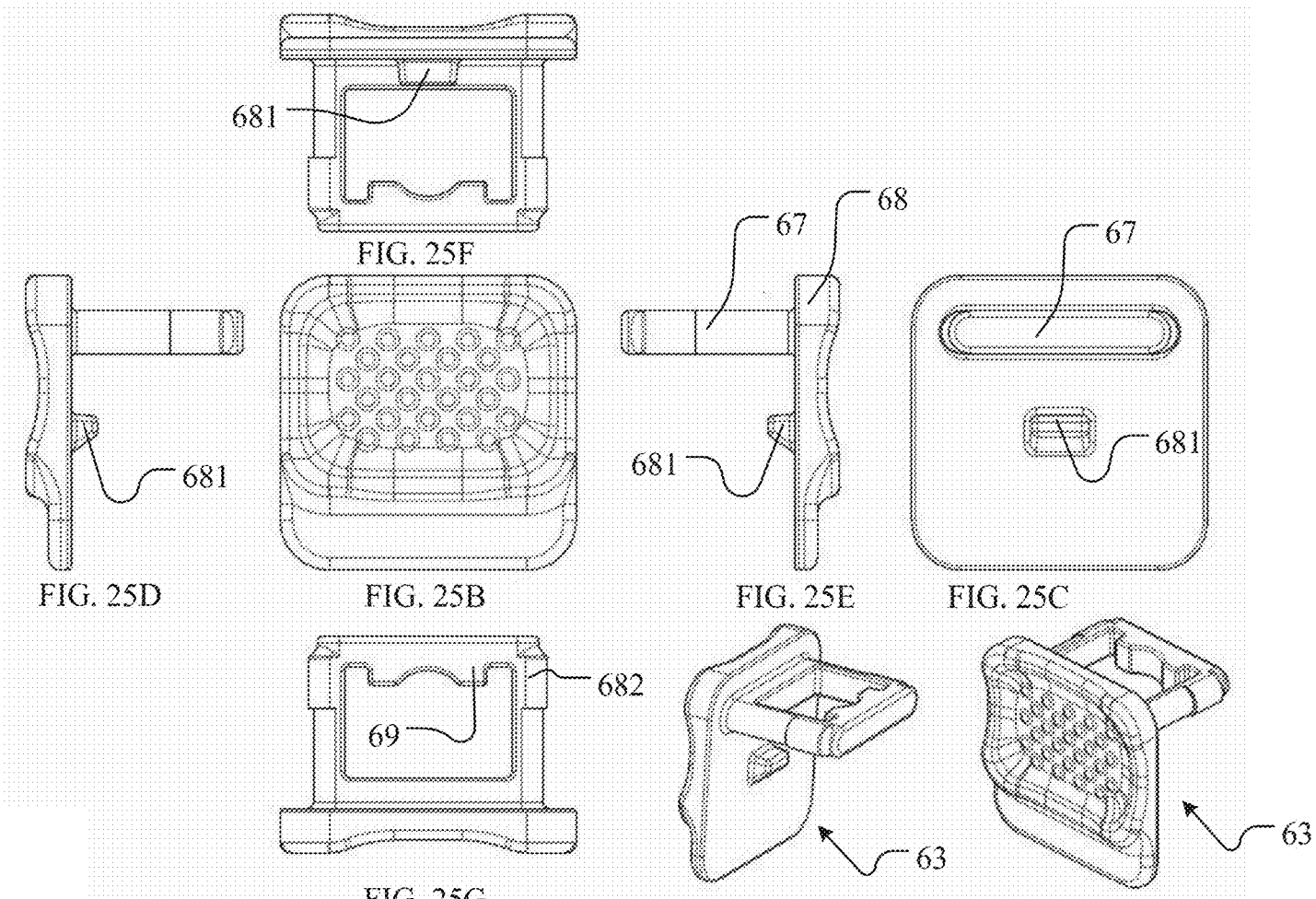
FIGS. 25A-H show views of an adjustment button of the adjustment mechanism in accordance with an embodiment of the present invention.
Figures 26A, 26B, 26C, 26D, 26E:
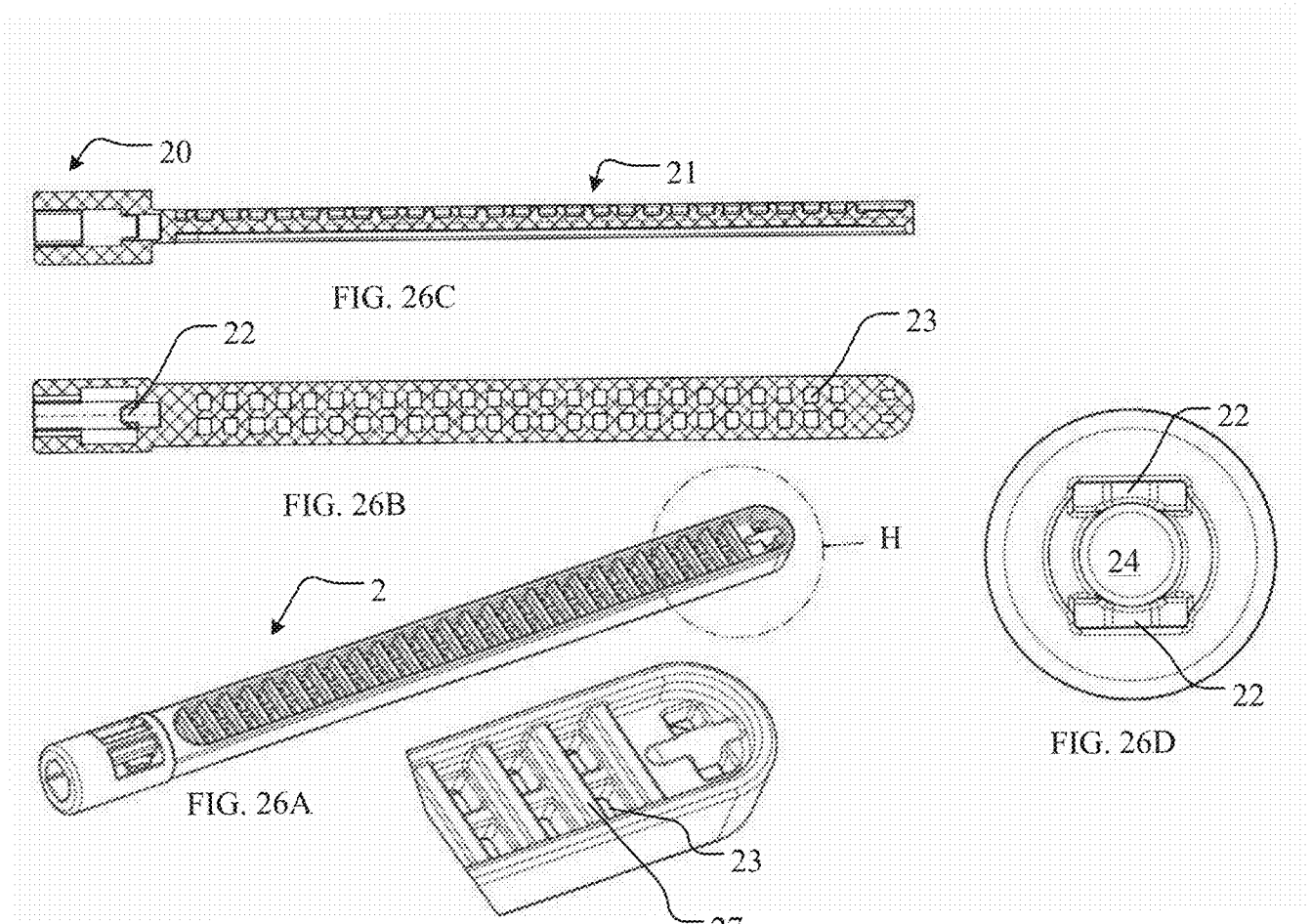
FIGS. 26A-E show views of a track of the lever member in accordance with an embodiment of the present invention.
Figures 27A, 27B, 27C, 27D, 27E:
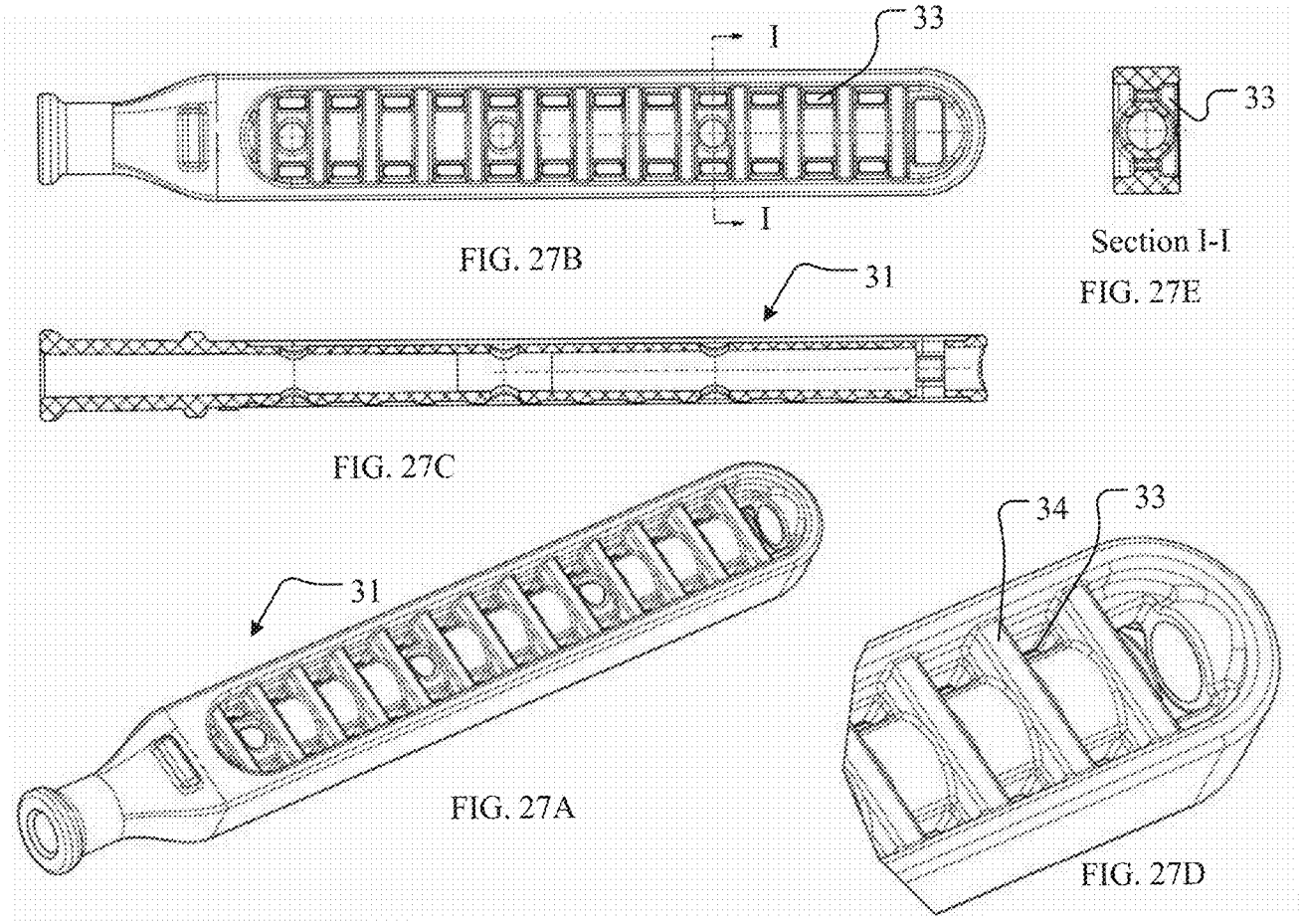
FIGS. 27A-E show views of the link rod in accordance with an embodiment of the present invention.

As shown in FIGS. 3, 13 and 22, the pull rod 1 may comprise a pull rod body 11 and a pull rod head 12 connected with each other through thread or the like. A snap portion 13 is formed at the bottom of the pull rod main body 11 and adapted to be snapped with the pull rod connector 9. The snap portion 13 comprises for example a ring groove 14 formed on an outer circumference of the pull rod 1, and a tip 15 defined by the ring groove 14 and having a tip taper section 16 tapering towards the bottom side.

Particularly with reference to FIGS. 23A-H, a pull rod connector 9 according to an embodiment of the present invention is shown. The pull rod connector 9 may comprise a top flange 91 and a pair of oppositely disposed and spaced flexible deformation portions 92 extending downwards from the top flange 91. The pair of flexible deformation portions 92 at their outer circumferential sides respectively defines a circumferential flange 93, on the bottom side of which a guiding slope 94 is formed. Through the top flange 91, the pair of flexible deformation portions 92 and the circumferential flange 93, the pull rod connector 9 can be snapped into the link rod 2, as described below. Moreover, the pull rod connector 9 defines a central hole 95 in the top flange 91 between the pair of flexible deformation portions 92, for snapping the snap portion 13 of the pull rod 1 so as to snap the pull rod 1 to the link rod 2. In an embodiment, to snap the snap portion 13 of the pull rod 1, the central hole 95 defines a large diameter section 96 and a small diameter section 97. A guiding slope 98 is formed between the large diameter section 96 and the small diameter section 97 for facilitating a relative sliding movement with the tip taper section 16 of the pull rod 1, such that the insertion of the pull rod snap portion 13 is facilitated.

Figure 21:
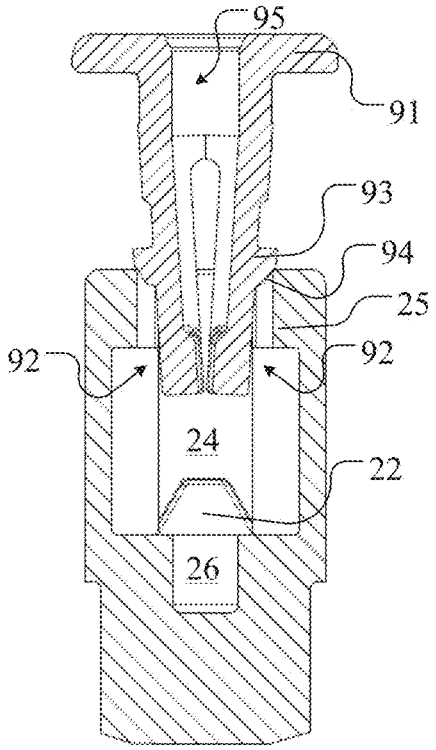
FIG. 21 schematically shows a pull rod connector being snapped into a receptacle of a link rod.

Particularly with reference to FIGS. 21, 22 and 26A-E, the link rod 2 at its upper end forms a receiving portion 20 for receiving the above-mentioned pull rod connector 9. Preferably, the receiving portion 20 is in form of a receptacle 24 which at its top forms an inward-extending circumferential flange 25. Accordingly, as shown in FIG. 21, the circumferential flanges 93 on the flexible deformation portions 92 are configured to move over the circumferential flange 25 of the receptacle by means of deformation of the flexible deformation portions 92 of the pull rod connector 9 (advantageously with the guiding slope 94), such that the pull rod connector 9 then is snapped into the receptacle 24, with the top flange 91 of the pull rod connector 9 kept outside the receptacle 24 in view of the dimension of the top flange 91.

Figure 14:
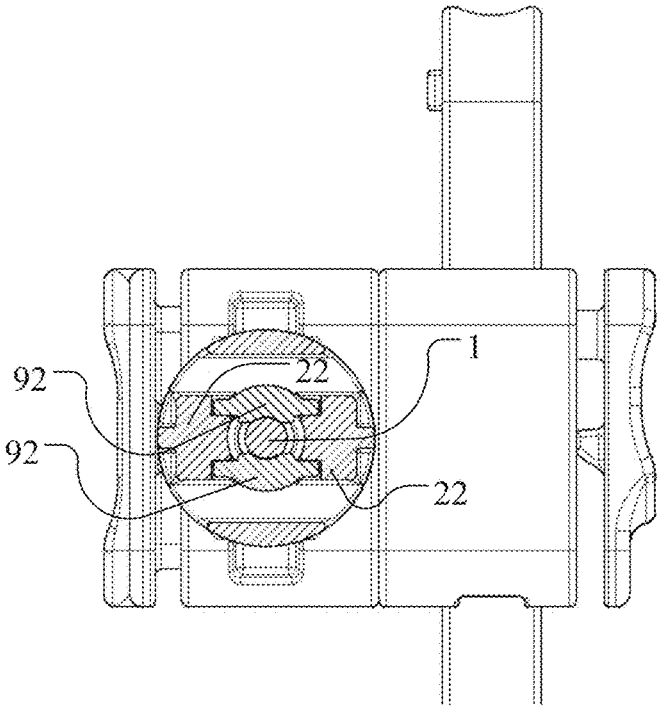
FIG. 14 shows a sectional view taken along the line E-E of FIG. 8.

The receptacle 24 at its bottom forms expansion portions 22 in form of a boss comprising a taper section tapering towards the upper end and for expanding the central hole 95 of the pull rod connector 9. Correspondingly, the flexible deformation portions 92 of the pull rod connector 9 at their bottom side form guiding slopes 99 cooperated with the taper section, as shown in FIGS. 23A-H. In the embodiment as shown in FIG. 14, the expansion portion 22 in form of the boss is preferably oriented transverse to the flexible deformation portions 92, so as to better expand the flexible deformation portions 92 and thus (at least the bottom area of) the central hole 95.

With such configuration mentioned above, where it is desired to couple the pull rod 1 to the link rod 2, the pull rod connector 9 is snapped into the receptacle 24 of the link rod 2, e.g., by an action of press. Now the flexible deformation portion 92 of the pull rod connector 9 rests on the expansion portion 22 without load applied. Subsequently, the pull rod 1 is inserted, such that the pull rod tip 15 with its taper section 16 pass over the guiding slope 98, in such a way that the pull rod in the region of the ring groove 14 engages with the small diameter segment 97, with the pull rod tip 15 at least partially disposed in a central recess 26 formed at the bottom of the receptacle. Optionally, when inserting the pull rod 1, the pull rod connector 9 is slightly pressed down such that the flexible deformation portions 92 thereof are slightly expanded by the expansion portion 22 to facilitate the insertion of the pull rod 1. In such a manner, the pull rod 1 is simply and reliably snapped in the link rod 2.

At the time of detaching the pull rod 1, the pull rod connector 9 is subjected to a downward press force against the expansion portion 22, such as by an action of press, such that the flexible deformation portions 92 and thus the central hole 95 are expanded by the expansion portion 22, which in turn allows the pull rod 1 to be effortlessly separated from the link rod 2 and the pull rod connector. Subsequently, the flexible deformation portions 92 can be optionally pushed toward each other so as to detach the pull rod connector. Alternatively, the pull rod connector 9 is not detached but merely with different kinds of pull rods inserted according to different occasions.

With such configuration mentioned above, it is considerably advantageous that connection between the pull rod and link rod of the present invention is rather simple, with damage minimized during assembly or disassembly of the components. It is thus intended that any new combinations obtained by combining the above-mentioned configurations of the pull rod assembly according to the invention with any other embodiments illustrated herein or with other parts of various prior art drain plug linkage devices, fall within the scope of the present invention.

A new configuration of operative connection between the link rod 2 and lever member 3 of the present invention, in particular the adjustment mechanism 6, will be described below with reference to the drawings.

As shown in FIGS. 3, 16, 17 and 26A-E, the link rod 2 may further comprises a track section 21. The track section may comprise multiple rows of retaining through-holes 23, with each row having a pair of the retaining through-holes 23. With such arrangement, each row of the retaining through-holes 23 may define one first adjustment position of the link rod 2 (by means of the adjustment mechanism 6), as described in details below. Although in the illustrated embodiment there are two retaining through-holes 23 arranged in each row, it is appreciated to provide only one or more than two retaining through-holes in each row as desired, which will fall within the scope of the present invention. As an alternative or in addition to the retaining through-holes 23 as illustrated, it is appreciated that any suitable retaining means, such as retaining grooves or the like can be utilized. Preferably, the link rod 2 may further comprise a reinforcement rib 27 formed between the adjacent rows of retaining through-holes 23, so as to provide the link rod 2 with higher structural strength.

As shown in FIGS. 3, 16, 17 and 27A-E, the lever member 3 similarly comprises a lever member track 31, and a lever member body 32 connected with the lever member track 31 e.g., by means of thread connection. The lever member track 31 may similarly comprise multiple rows of retaining through-holes 33. In the illustrated embodiment, each row of the retaining through-holes 33 comprises a pair of the retaining through-holes 33. With such arrangement, each row of the retaining through-holes 33 may define one second adjustment position of the lever member 3 (through the adjustment mechanism 6), as described in details below. Although in the illustrated embodiment there are two retaining through-holes 33 arranged in each row, it is appreciated to provide only one or more than two retaining through-holes in each row as desired, which will fall within the scope of the present invention. As an alternative or in addition to the retaining through-holes 33 as illustrated, it is appreciated that any suitable retaining means, such as retaining grooves or the like can be utilized. Preferably, the lever member track 31 may further comprise a reinforcement rib 34 formed between the adjacent rows of retaining through-holes 33, so as to provide the lever member 31 with higher structural strength. In addition, although in the illustrated embodiment the lever member track 31 and lever member body 32 are detachable from each other, they may also be formed integrally or a single unitary lever member may define a track section, which with fall within the scope of the present invention.

As shown in FIGS. 3-8, 12, 14-17, 24A-H and 25A-H, the adjustment mechanism 6 according to the embodiment of the present invention mainly comprises two adjustment units, i.e. a first adjustment unit for adjusting the position of the lever member 3 and a second adjustment unit for adjusting the position of the link rod 2, connected with each other, such that the adjustment mechanism is able to adjust the positions of the lever member 3 and link rod 2 independently. In the illustrated embodiment, the first adjustment unit comprises a first adjustment slider 61 arranged over the lever member 3, and a first adjustment button 63 inserted into the first adjustment slider 61; the second adjustment unit comprises a second adjustment slider 62 arranged over the link rod 2, and a second adjustment button 64 inserted into the second adjustment slider 62. In the illustrated embodiment, connection between the first adjustment unit and the second adjustment unit is provided by means of a pin 65 passing through pin holes 614 in the first and second adjustment sliders (only one pin hole in the first adjustment slider shown) respectively, and a clamping member 66 for holding the pin 65.

With reference to FIGS. 24A-H, the first adjustment slider is taken as an example to describe the slider of the adjustment mechanism according to the present invention. In the illustrated embodiment, the first adjustment slider is identical with the second adjustment slider in sense of construction and dimension. Nevertheless, it will be understood by the person skilled in the art that the configurations, features or dimensions of the first and second adjustment sliders can be the same or different to meet the requirement of the adjustment function according to the teaching of the present invention. In the drawings, the first adjustment slider 61 may comprise a through-hole 613 passing through the first adjustment slider and being arranged over the lever member 3. The first adjustment slider 61 may further comprise a side opening 612 disposed on one side for facilitating the insertion of the first adjustment button 63. Moreover, the adjustment slider may also comprise an elastic-deformable biasing portion 611 disposed on the side, and a cut-out 615 around the biasing portion 611 for facilitating its deformation.

Still with reference to FIGS. 15 and 25A-H, the first adjustment button 63 may comprise a first press portion 68 adapted to be press-operated, and a first engagement portion 67 extending from the first press portion 68 and having a pair of protrusions 69 for engaging one pair of the retaining through-holes 33 of the lever member 3. Nevertheless, it will be understood to configure other retaining structures and the number thereof as required, which falls within the scope of the present invention. In the drawings, the first engagement portion 67 comprises a pair of arms extending outwards and a web connecting the arms at their ends. The protrusion 69 is arranged on the web, such that the protrusion 69 is disposed oppositely to the first press portion 68. The first press portion on a side opposite to the protrusion 69 forms a ledge 681, which is configured to contact with said biasing portion 611, such that when the first adjustment button 63 is pressed, the protrusion 69 is separated from the stopping through-holes of the lever member 3 against the elasticity of the bias portion 611, such that the first adjustment slider 61 now is allowable to be adjusted freely along the lever member 3. The first adjustment button 61 then is released after moving to a desired adjustment position, such that the protrusion 69 is snapped into the corresponding retaining through-holes 33 of the lever member 3 under action of the biasing portion 611. Moreover, the arms of the first engagement portion 67 form a flange 682, which is engaged with a shoulder 616 in the first adjustment slider 61 so as to prevent the first adjustment button 63 from being detached.

Figure 15:
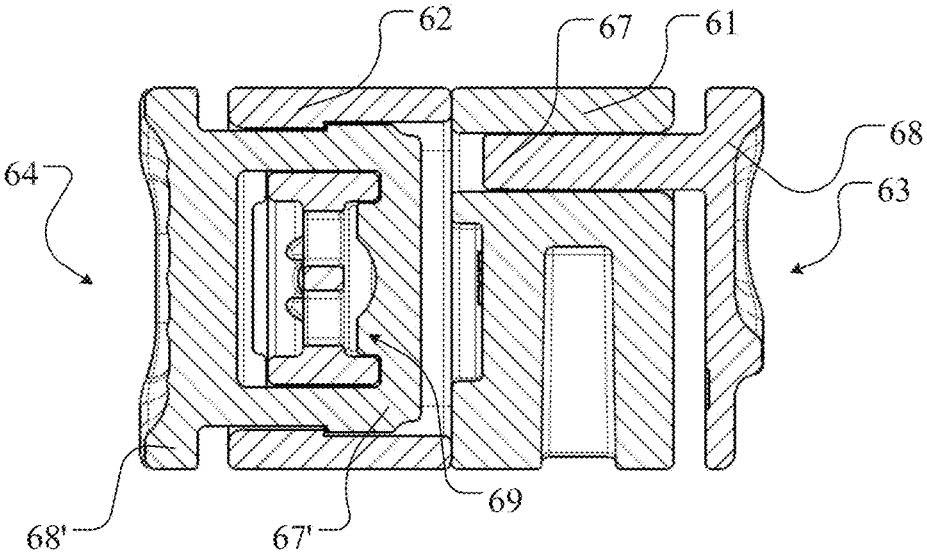
FIG. 15 shows a sectional view taken along the line F-F of FIG. 8.
Figure 16:
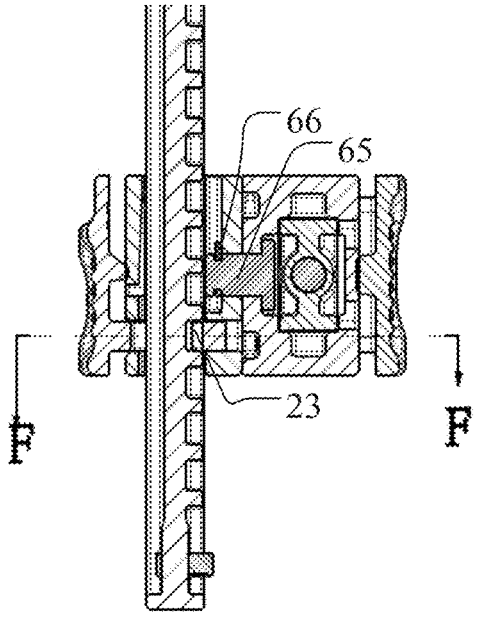
FIG. 16 shows a partially enlarged view of FIG. 8.
Figure 17:
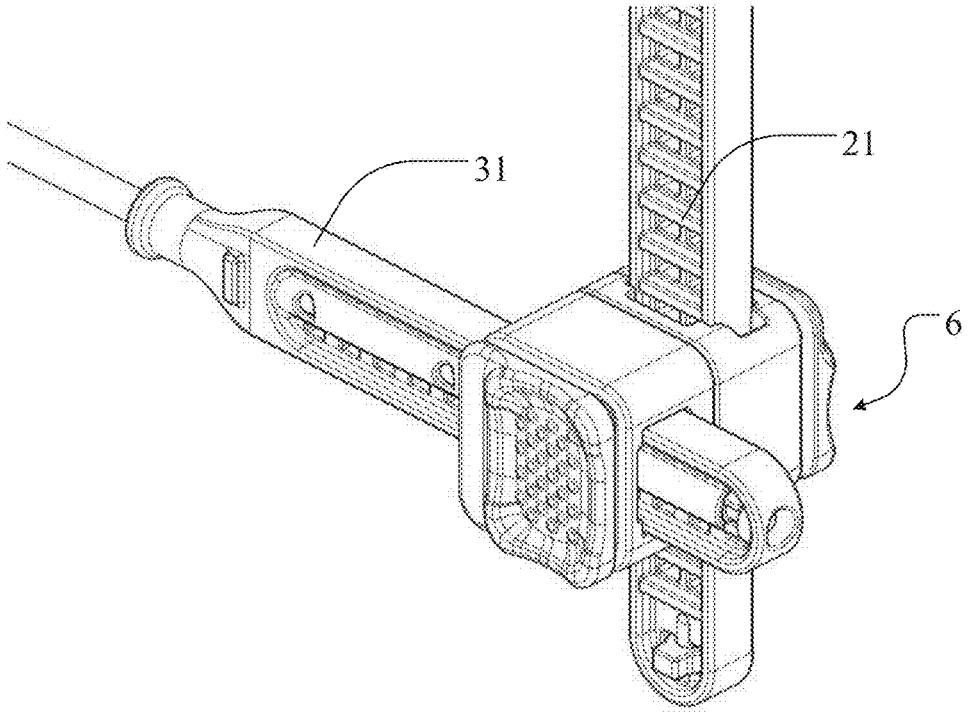
FIG. 17 is a partial view, illustrating an adjustment mechanism for adjustably connecting a lever member and a link rod.

The second adjustment unit, i.e. the second adjustment slider and the second adjustment button, is optionally provided with the functionality and/or structures similar to those of the first adjustment slider and the first adjustment button as mentioned above. For instance, the second adjustment button 64 may also comprise a second engagement portion 67' and a second press portion 68', as shown in FIG. 15.

Figure 5:
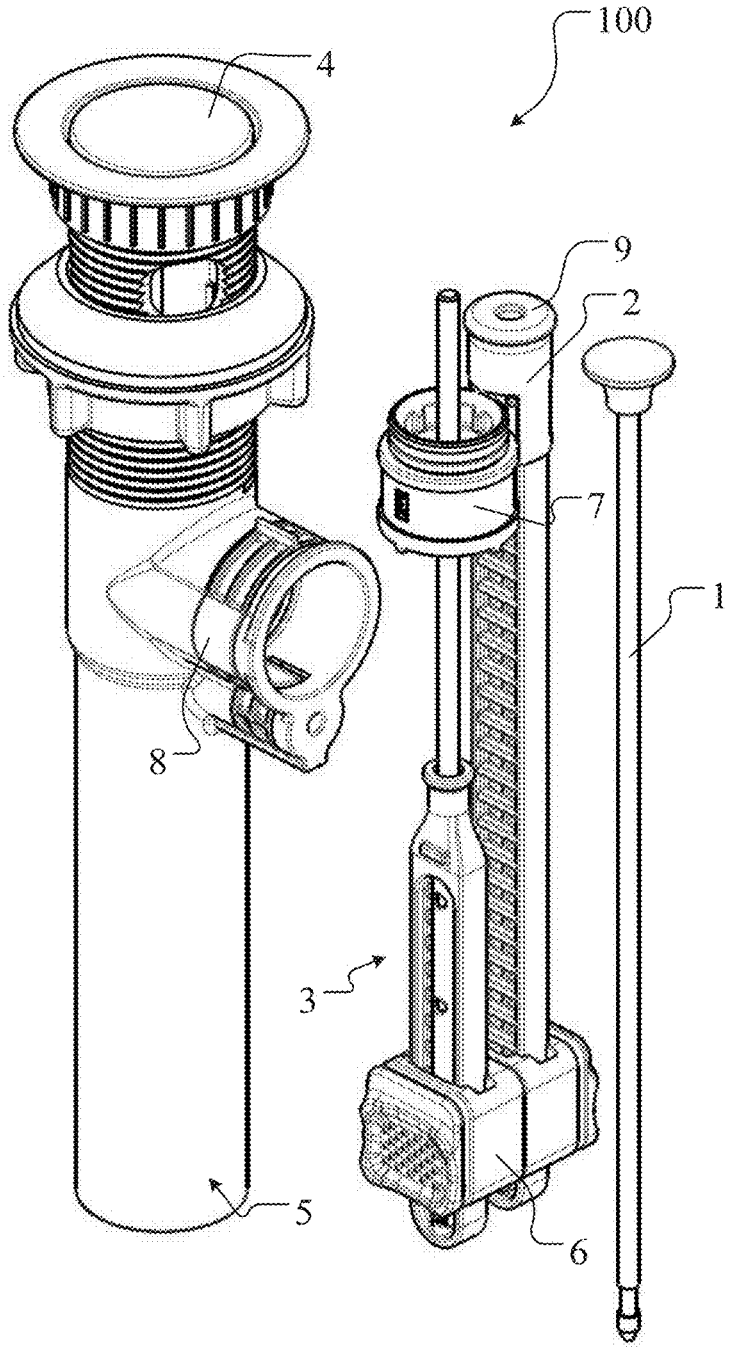
FIG. 5 shows a partially assembling view of a drain plug linkage device in accordance with the embodiment of the present invention.
Figure 6:
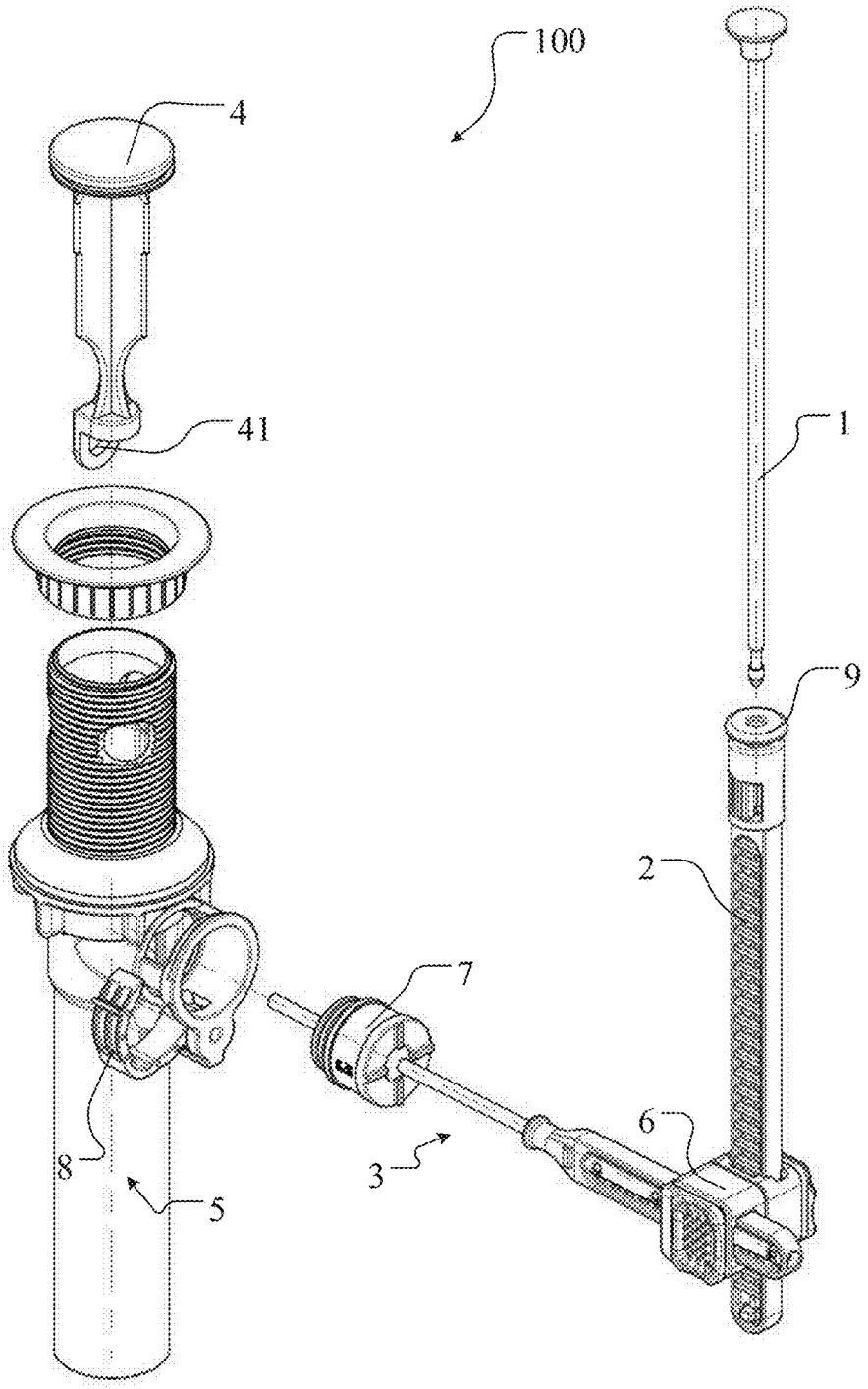
FIG. 6 shows a partially exploded view of a drain plug linkage device in accordance with the embodiment of the present invention.
Figure 7:
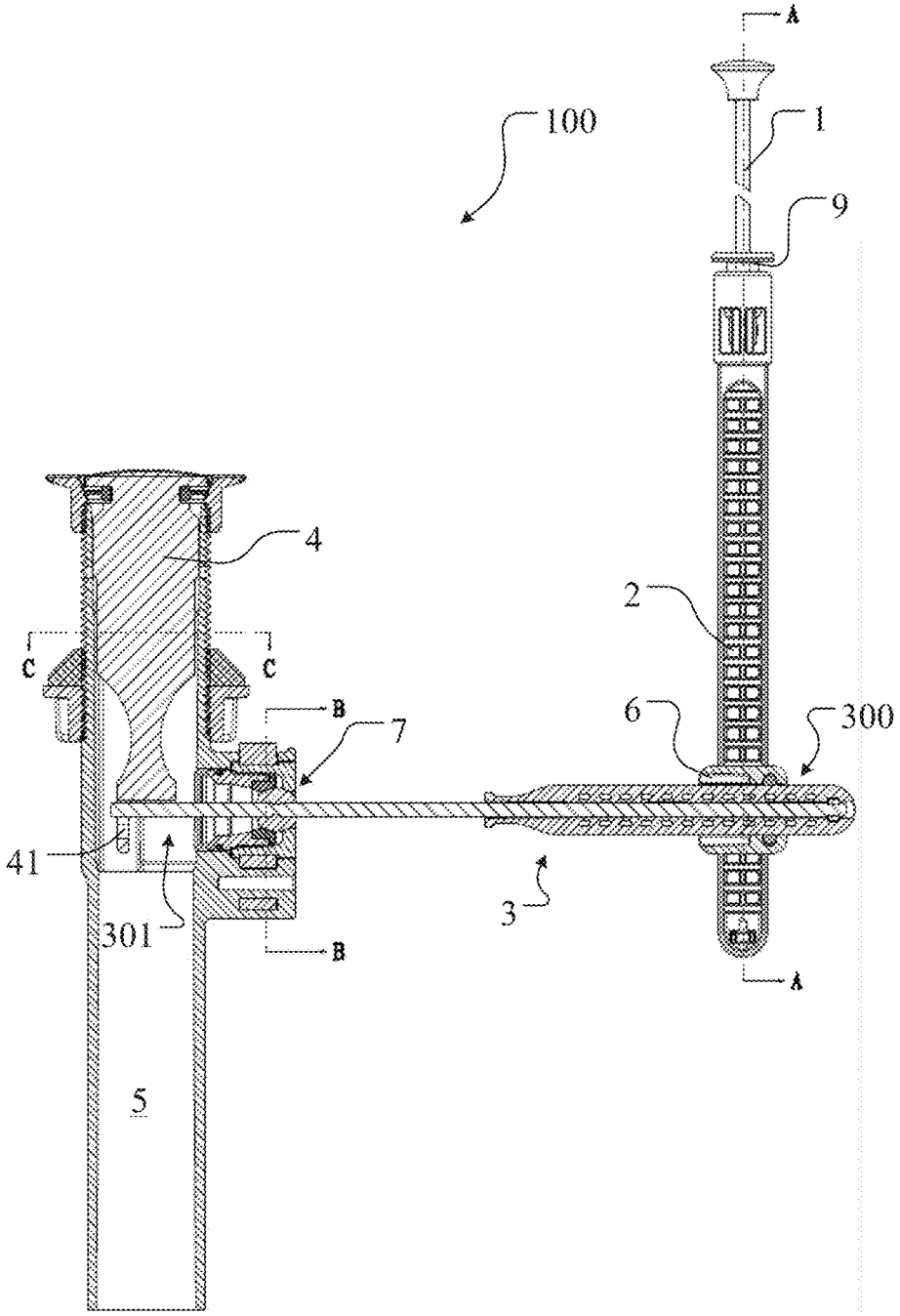
FIG. 7 shows a sectional view of a drain plug linkage device in accordance with the embodiment of the present invention.
Figure 8:
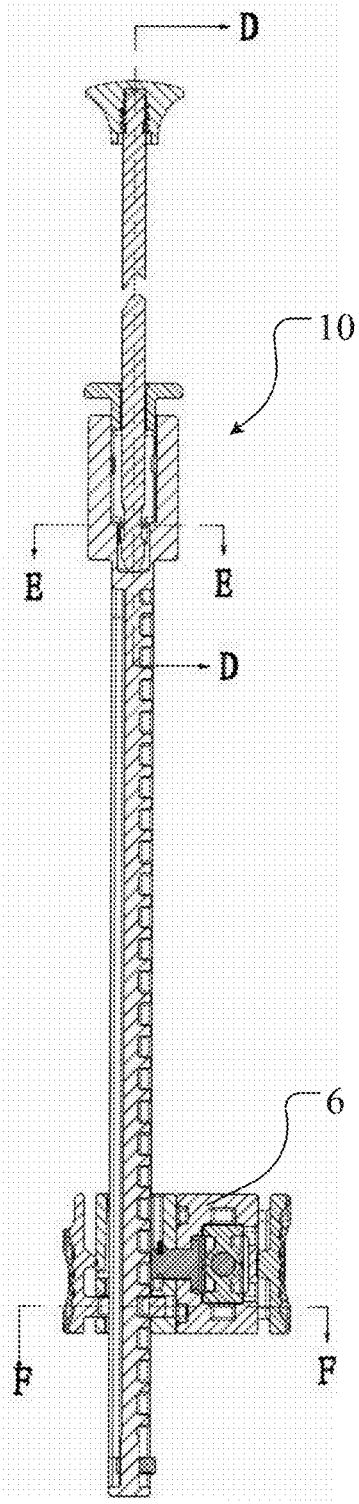
FIG. 8 shows a sectional view taken along the line A-A of FIG. 7.
Figure 9:
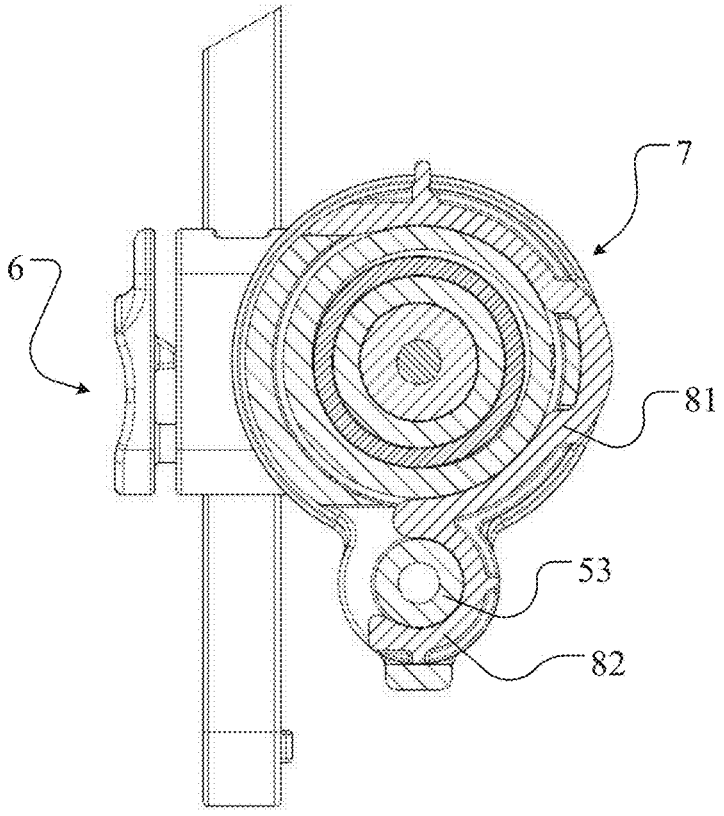
FIG. 9 shows a sectional view taken along the line B-B of FIG. 7.

In the drawings, the link rod 2 is substantially perpendicular to the lever member 3 (e.g. forming an angle greater than 45 degrees therebetween) in operating condition as shown in FIG. 6, because of the configuration of the pin 65 and the clamping member 66, such that the components of the first adjustment unit are substantially perpendicular to the corresponding components of the second adjustment unit (e.g. the through-holes and the side opening). During transportation as well as during a possible great movement of the pull rod, the link rod 2 can be positioned substantially in line with the lever member 3 (e.g. forming an angle smaller than 45 degrees) as shown in FIG. 5. In accordance with such configuration of the present invention, the adjustment mechanism 6 is further able to represent a smaller storage dimension and greater freedom degree of relative movement.

Thanks to the configuration above, the adjustment mechanism 6 of the present invention can be easily adjusted with damages to the components minimized during the adjustment. It is thus intended that any new combinations obtained by combining the above-mentioned configurations of the adjustment mechanism according to the invention with any other embodiments illustrated herein or with other parts of various prior art drain plug linkage devices, fall within the scope of the present invention.

Further with reference to the accompanying drawings, in particular to FIGS. 9, 11 and 18-20, an embodiment of a pivot assembly 7 and a fastening mechanism 8 for fastening the pivot assembly 7 to the pipe body 5 according to the present invention is shown. As mentioned before, in the prior art, the lever member is fixed with or integrally formed with a spherical part, which but usually is pivotably mounted in a receiving port of the pipe body by means of a locking nut, which requires the lever member (the spherical part) to be screwedly mounted in narrow space and causes assembling difficulty.

In the illustrated embodiment, the drain plug linkage device 100 according to the embodiment of the present invention comprises the pivot assembly 7 disposed in a receiving port 51 of the pipe body 5 (usually transverse to the main body of the pipe body 5), and the fastening mechanism 8 in form of a snapping member for fastening the pivot assembly in the receiving port. The pivot assembly 7 comprises a sleeve means, and a spherical portion 71 pivotably arranged in the sleeve means and mounted to the lever member 3 between the first end 300 and the second end 301 of the lever member 3. The sleeve means comprises a pivot sleeve 72 and a support washer 73 engaging with the spherical portion 71 from two sides respectively, and a fastening sleeve 74 secured to the pivot sleeve 72 such as by means of threading.

Figure 18:
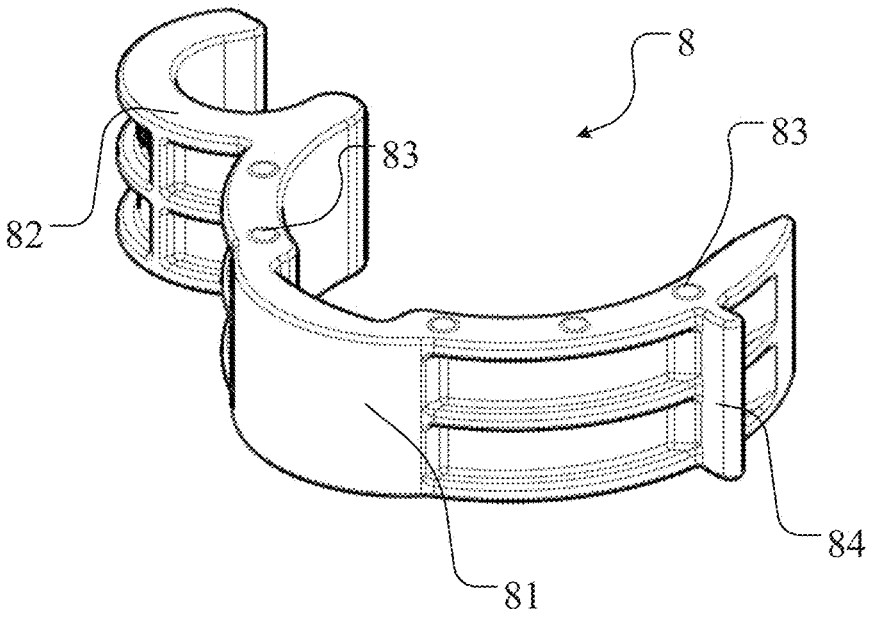
FIG. 18 and FIG. 19 show a fastening mechanism in form of a snapping member.
Figure 19:
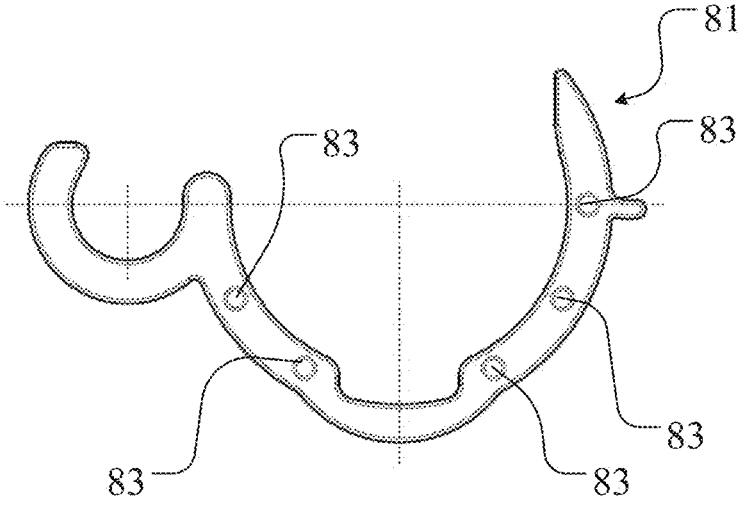
Figure 20:
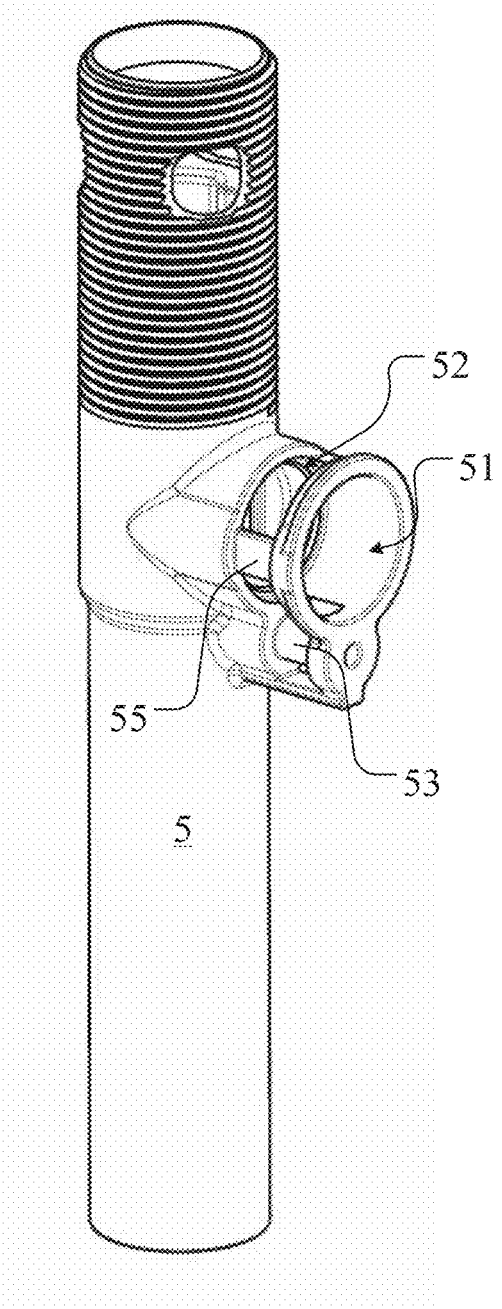
FIG. 20 shows a piping member.

Particularly with reference to FIGS. 18-20, the snapping member comprises unitary arc-shaped snapping segment 81 having an arc shape preferably greater than or equal to a semi-circle, and a unitary arc-shaped pivoting segment 82 being preferably no smaller than a semi-circle. Correspondingly, a wall of the receiving port 51 forms a circumferential cut-out 52 for receiving the arc-shaped snapping segment 81. A pivot 53 is defined under the circumferential cut-out 52. The arc-shaped pivoting segment is snapped on the pivot 53, such that the arc-shaped pivoting segment 82 is allowable to be snapped into or released from the circumferential cut-out by a pivoting movement around the pivot. The circumferential cut-out 52 is preferably provided with a strength rib for effectively increasing strength.

Figure 4:
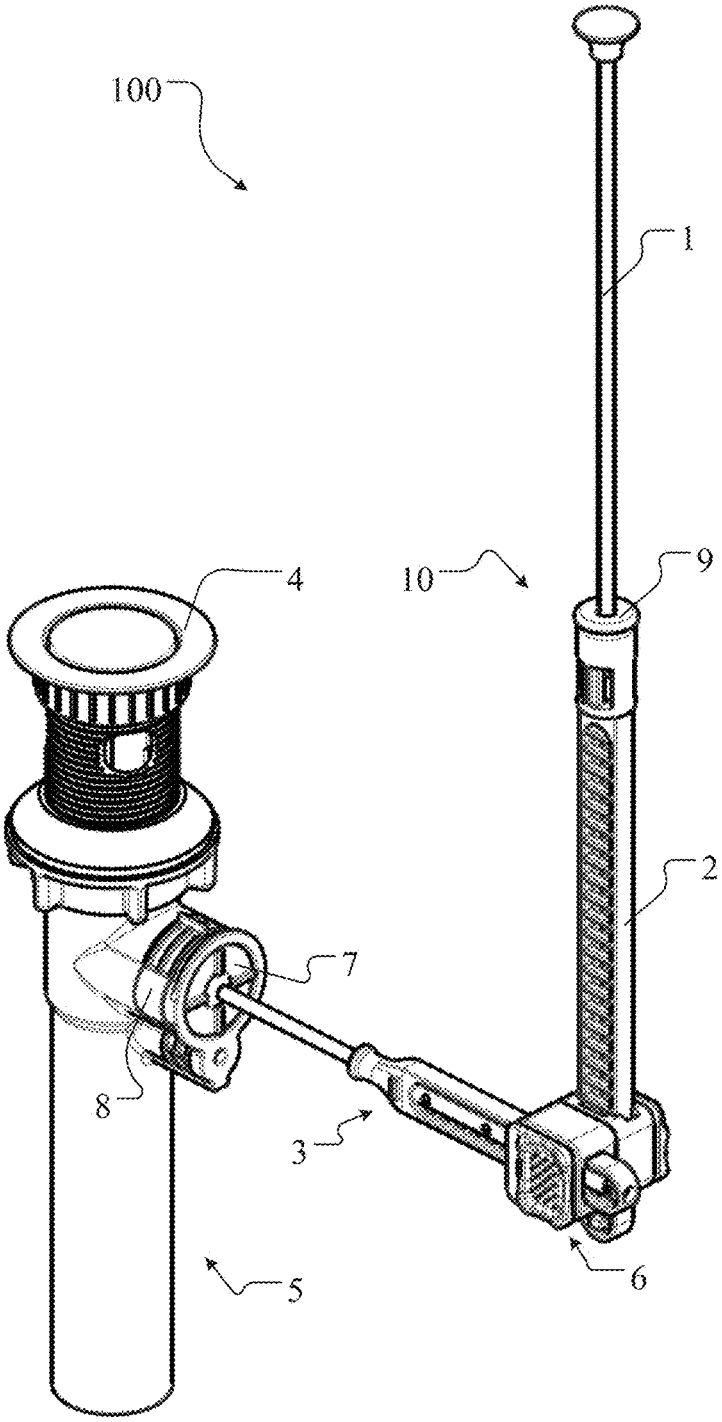
FIG. 4 shows an assembly view of a drain plug linkage device in accordance with the embodiment of the present invention.

At least at the time of mounting the lever member 3 and the pivot assembly 7 into the receiving port 51 of the pipe body 5, the lever member 3 and the pivot assembly 7 are in form of assembly to be inserted into the receiving port 51, with a sealing member optionally arranged between the pivot assembly 7 and the receiving port 51. Subsequently, the pivot assembly 7 is fastened into the receiving port 51 by simply pivoting the snapping member 8 (from a position as illustrated in FIG. 6 to a position as illustrated in FIG. 4).

To effectively improve snapping, the arc-shaped snapping segment 81 is preferably provided with an interference fit point 83 at the side thereof. Alternatively or additionally, the interference fit point is arranged at the side of the circumferential cut-out 52 of the receiving port 51 (i.e., the side contacting with the arc-shaped snapping segment 81).

Preferably, the snapping member 8 is provided with a tab 84 for facilitate manipulation of an operator.

By means of the configuration mentioned above, the pivot assembly 7 of the present invention can be simply assembled, avoiding from screwing the nut in the narrow space difficultly. It is thus intended that any new combinations obtained by combining the above-mentioned configurations of the pivot assembly 7 and fastening mechanism 8 of the present invention with any other embodiments illustrated herein or with other parts of various prior art drain plug linkage devices, fall within the scope of the present invention.

Figure 10:
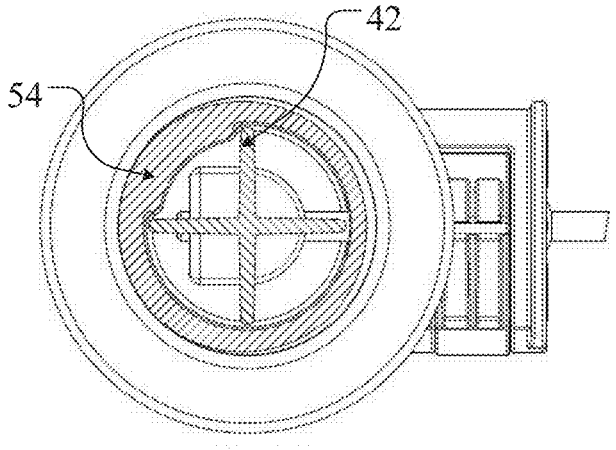
FIG. 10 shows a sectional view taken along the line C-C of FIG. 7.
Figure 11:
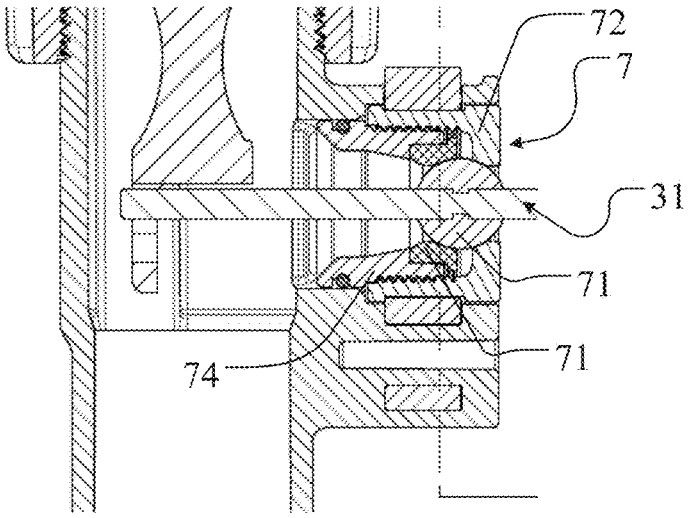
FIG. 11 shows a partially enlarged view of FIG. 7.
Figure 12:
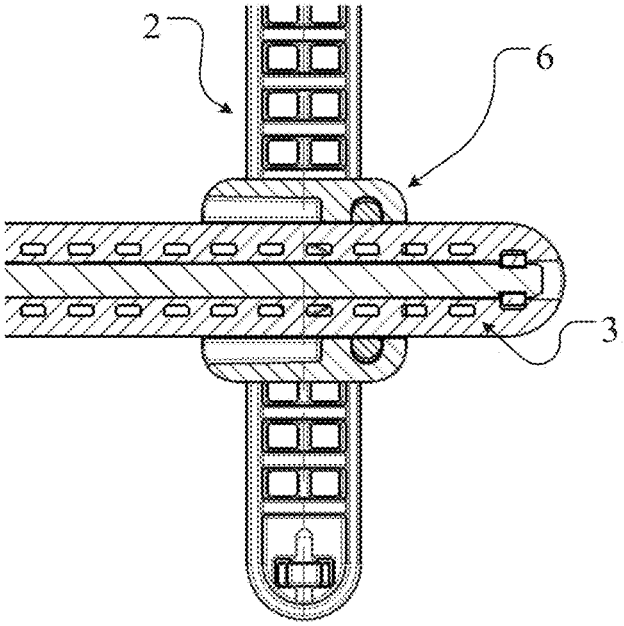
FIG. 12 shows a partially enlarged view of FIG. 7.

As shown in FIG. 10, the drain plug 4 is preferably provided with a reinforcement rib 42, and a positioning protrusion 54 is correspondingly arranged inside the pipe body 5, so as to facilitate positioning of the drain plug 4 within the pipe body 5, and further facilitate mounting of the lever member 3 and the pivot assembly 7.

Figure 28:
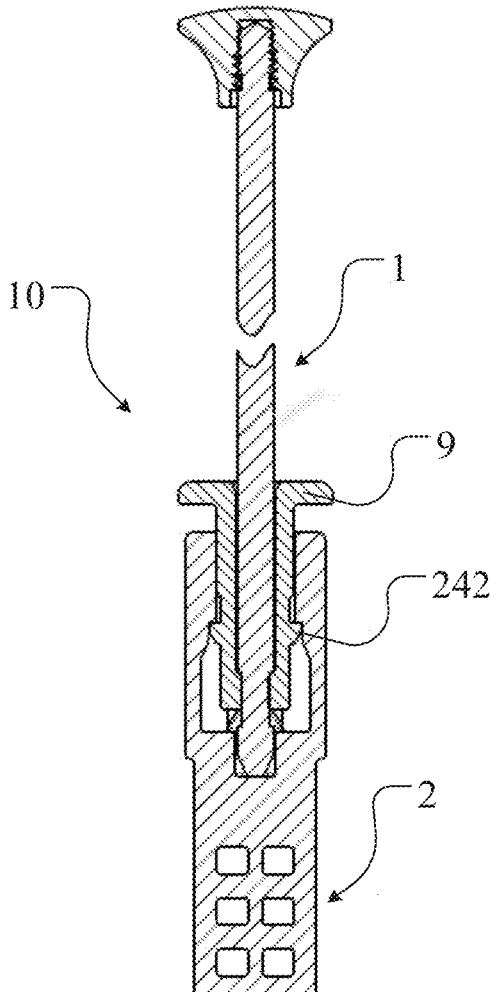
FIGS. 28-30 show partially sectional views of a drain plug linkage device in accordance with an embodiment of the present invention, particularly illustrating cooperating arrangement of a pull rod, pull rod connector and link rod.
Figure 29:
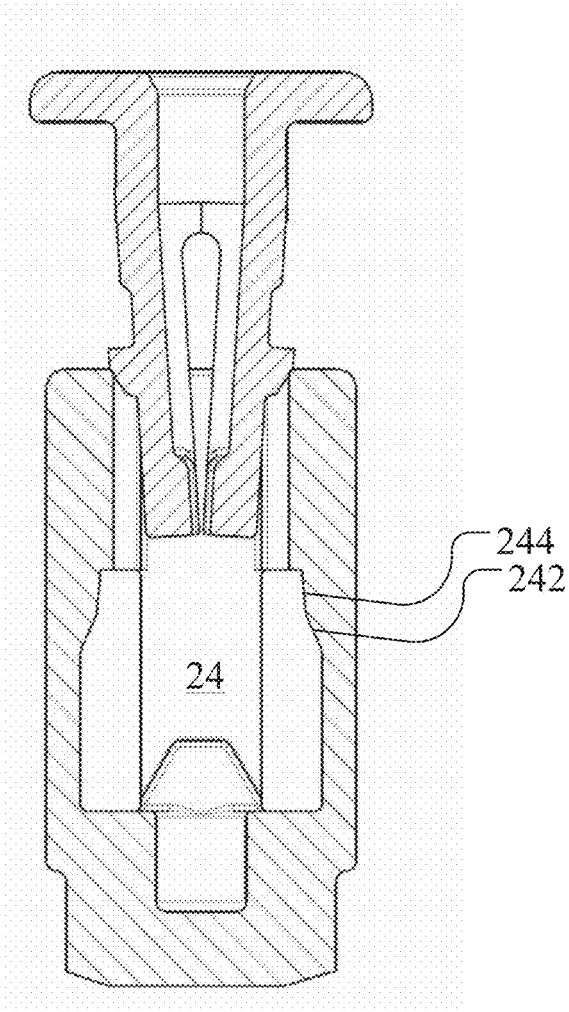
Figure 30:
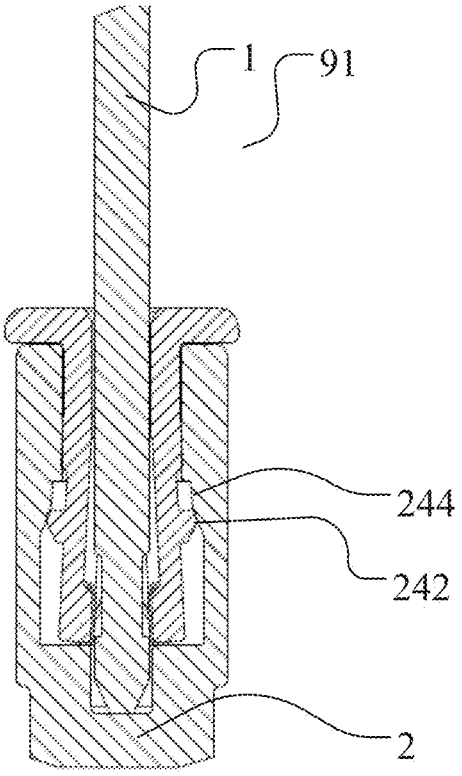

Further with reference to FIGS. 28-30, another embodiment of the drain plug linkage device according to the present invention, specifically another fitting configuration of the pull rod, pull rod connector and link rod, is shown. FIG. 28 is substantially corresponding to FIG. 13, FIG. 29 is substantially corresponding to FIG. 21, FIG. 30 is substantially corresponding to FIG. 22, and the difference thereof lies in that the side wall of the receptacle 24 at the upper end of the link rod 2 forms structural features 242 and 244 adapted to fit with the circumferential flange 93 of the pull rod connector 9. The structural feature 242 is in form of a guiding slope for facilitating disassembly of the pull rod connector. The structural feature 244 is in form of a substantially straight cylinder wall having a size matching with, e.g. equal to or slightly smaller than, that of the circumferential flange 93. Through the guiding slope 242 and optionally cylinder wall 244, when pulling the pull rod in the assembly condition, the flexible deformation portion 92 of the pull rod connector 9 upwardly slides into the guiding slope 242 and possibly into the cylinder wall 244, such that the flexible deformation portions 92 would not be expanded, with the pull rod 1 safely clamped therebetween, so as to ensure undetachablity and reliability of the pull rod assembly. It shall be understood that the specification is described according to each of the embodiments, but not each embodiment only contain one independent technical solution, the specification is described in such a way merely for the purpose of clearness, the specification should be considered by the person skilled in the art as a whole, and the technical solutions of each embodiment can be appropriately combined to form other embodiments understandable to the person skilled in the art. The inventive features disclosed by the specification is not indispensable, each inventive feature can be combined with other prior configurations to reach new technical solutions, which will all fall in the scope of the present invention.

The above are only exemplary embodiments of the present invention, and not for limiting the scope of the present invention. It should be understood by the person skilled in the art to make equivalent variations, modifications and combinations within the spirit and scope of the invention, which fall in the claimed scope of the present invention.

LIST OF REFERENCE NUMERALS

| | |
|---|---|
| 1—pull rod | 24—receptacle |
| 2—link rod | 242—guiding slope |
| 3—lever member | 244—cylinder wall |
| 4—drain plug (rocket) | 25—circumferential flange |
| 5—pipe | 26—central recess |
| 6—adjustment mechanism | 27—reinforcement rib |
| 7—pivot assembly | 31—lever member track |
| 8—snapping member | 32—lever member body |
| 9—pull rod connector | 33—retaining through-hole |
| 10—pull rod assembly | 34—reinforcement rib |
| 11—pull rod body | 300—first end |
| 12—pull rod head | 301—second end |
| 13—snapping portion | 41—aperture |
| 14—ring groove | 42—reinforcement rib |
| 15—tip | 51—receiving port |
| 16—tip taper section | 52—circumferential cut-out |
| 20—receiving portion | 53—pivot |
| 21—track section | 54—positioning protrusion |
| 22—expansion portion | 55—reinforcement rib |
| 23—retaining through-hole | 59—sealing member |
| 61—first adjustment slider | 71—spherical portion |
| 611—biasing portion | 72—pivot sleeve |
| 612—side opening | 73—support washer |
| 63—through-hole | 74—fastening sleeve |
| 614—pin hole | 81—arc-shaped snapping segment |
| 615—cut-out | 82—pivoting segment |
| 616—shoulder | 83—interference fit point |
| 62—second adjustment slider | 84—tab |
| 63—first adjustment button | 91—top flange |
| 64—second adjustment button | 92—flexible deformation portion |
| 65—pin | 93—circumferential flange |
| 66—clamping member | 94—guiding slope |
| 67—first engagement portion | 95—central hole |
| 67'—second engagement portion | 96—large diameter segment |
| 68—first press portion | 97—small diameter segment |
| 68'—second press portion | 98—guiding slope |
| 681—ledge | 99—guiding slope |
| 682—flange | 100—drain plug linkage device (discharge device) |
| 69—protrusion | |

What is claimed is:

1. A drain plug linkage device, comprising:

a drain plug at least partially disposed in a pipe body;

a pull rod assembly including a pull rod, a link rod and a pull rod connector, wherein the link rod at its upper end has a receiving portion, the pull rod connector comprises a central hole and is adapted to be snapped into the receiving portion, and the pull rod at its bottom comprises a snap portion adapted to be snapped into the central hole; and a lever member comprising a first end operatively connected with the link rod, and a second end extending into the pipe body and configured to operate the drain plug;

wherein the receiving portion comprises an expansion portion for expanding the central hole; and the pull rod connector is configured, when snapped into the receiving portion, to be movable as a unitary body in a first axial direction along a longitudinal axis of the pull rod between:

a first position, wherein the central hole is unexpanded, and the pull rod is configured to be selectively coupled to the pull rod connector; and a second position, wherein the central hole is expanded by the expansion portion, and the pull rod is movable in a second axial direction along the longitudinal axis of the pull rod that axially opposes the first direction to remove the pull rod from the pull rod connector.

2. The drain plug linkage device according to claim 1, wherein the receiving portion is in form of a receptacle comprising an inwardly-extending circumferential flange for snapping the pull rod connector.

3. The drain plug linkage device according to claim 2, wherein the pull rod connector comprises a top flange, and a pair of oppositely disposed and spaced flexible deformation portions extending from the top flange.

4. The drain plug linkage device according to claim 3, wherein a guiding slope is formed at bottom side of the pair of flexible deformation portions, and the expansion portion comprises a taper section corresponding to the guiding slope.

5. The drain plug linkage device according to claim 3, wherein the flexible deformation portions comprises an outwardly-extending circumferential flange, and the circumferential flange of the receptacle has an inner diameter smaller than outer diameter of the circumferential flange of the flexible deformation portions and is disposed between the top flange and the circumferential flange of the flexible deformation portions.

6. The drain plug linkage device according to claim 5, wherein the receptacle comprises a lateral guiding slope for fitting the circumferential flange of the pull rod connector.

7. The drain plug linkage device according to claim 1, wherein the central hole comprises a large diameter section and a small diameter section, and the snap portion comprises a ring groove adapted to be snapped in the small diameter section, and a tip defined by the ring groove.

8. The drain plug linkage device according to claim 7, wherein a guiding slope is formed between the large diameter section and small diameter section, and the tip comprises a tip taper section.

9. The drain plug linkage device according to claim 1, wherein the pipe body comprises a receiving port, and the drain plug linkage device further comprises a pivot assembly disposed in the receiving port, and a fastening mechanism for fastening the pivot assembly in the receiving port, the pivot assembly comprising a sleeve means, and a spherical portion pivotably arranged in the sleeve means and mounted to the lever member between the first and second ends of the lever member.

10. The drain plug linkage device according to claim 9, wherein the sleeve means comprises a pivot sleeve and a support washer engaging with the spherical portion as well as a fastening sleeve for fastening the pivot sleeve and the support washer together.

11. The drain plug linkage device according to claim 9, wherein the receiving port comprises a circumferential cut-out, and the fastening mechanism is in form of a snapping member comprising an arc-shaped snapping segment snapped and fixed in the circumferential cut-out and having an arc shape greater than or equal to a semicircle.

12. The drain plug linkage device according to claim 11, wherein the circumferential cut-out and/or the arc-shaped snapping segment at a snapped position have an interference fit point.

13. The drain plug linkage device according to claim 11, wherein the pipe body is provided with a pivot, and the snapping member comprises an arc-shaped pivoting segment pivotally mounted on the pivot.

14. A drain plug linkage device, comprising:

a drain plug at least partially disposed in a pipe body;

a pull rod assembly including a pull rod and a link rod;

a lever member comprising a first end operatively connected with the link rod, and a second end extending into the pipe body and configured to operate the drain plug; and an adjustment mechanism operatively connecting the lever member to the link rod, wherein the lever member has a plurality of first adjustment positions, the link rod has a plurality of second adjustment positions, and the adjustment mechanism is configured to be engaged into one of the plurality of first adjustment positions and also one of the plurality of second adjustment positions;

wherein, the adjustment mechanism comprises:

a first adjustment slider disposed over the lever member;

a second adjustment slider disposed over the link rod and connected with the first adjustment slider;

a first adjustment button inserted into the first adjustment slider and having a first engagement portion engaging a selected one of the first adjustment positions to prevent sliding the first adjustment slider along a longitudinal axis of the lever member, wherein depressing the first adjustment button enables sliding the first adjustment slider along the longitudinal axis of the lever member; and a second adjustment button inserted into the second adjustment slider and having a second engagement portion engaging into a selected one of the second adjustment positions to prevent sliding the second adjustment slider along the longitudinal axis of the link rod, wherein depressing the second adjustment button enables sliding the second adjustment slider along the longitudinal axis of the link rod.

15. The drain plug linkage device according to claim 14, wherein:

the first adjustment slider comprises a first biasing portion configured to bias the first engagement portion to engage into the first adjustment position; and the second adjustment slider comprises a second biasing portion configured to bias the second engagement portion to engage into the second adjustment position.

16. The drain plug linkage device according to claim 14, wherein the lever member comprises a plurality of grooves and/or through-holes, at least one of the grooves and/or through-holes defining one of the first adjustment positions, wherein the first adjustment button comprises a press portion integrated or connected with the first engagement portion and comprising a ledge in contact with the first biasing portion, and wherein the first engagement portion comprises a protrusion arranged oppositely to the press portion and configured to be engageable into the groove and/or through-hole.

17. The drain plug linkage device according to claim 14, wherein the link rod comprises a plurality of grooves and/or through-holes, at least one of the grooves and/or through-holes of the link rod defining one of the second adjustment positions, wherein the second adjustment button comprises a press portion integrated or connected with the second engagement portion and comprising a ledge in contact with the second biasing portion, and wherein the second engagement portion comprises a protrusion arranged oppositely to the press portion and configured to be engageable into the groove and/or through-hole of the link rod.

18. The drain plug linkage device according to claim 15, wherein the adjustment mechanism further comprises a pin inserted into the first and second sliders, and a clamping member for securing the pin.

19. A drain plug linkage device, comprising:

a drain plug at least partially disposed in a pipe body, wherein the pipe body comprises a receiving port, the receiving port including a circumferential cut out and a pivot;

a pull rod assembly;

a lever member comprising a first end operatively connected with the pull rod assembly, and a second end extending into the pipe body and configured to operate the drain plug;

a pivot assembly disposed in the receiving port, wherein the pivot assembly comprises a pivot sleeve mounted to the lever member between the first end and second end of the lever member and a spherical portion pivotably arranged in the pivot sleeve; and a fastening mechanism, wherein the fastening mechanism is arc shaped and capable of pivoting about the pivot on the receiving port to engage the pivot sleeve through the circumferential cut out of the receiving port to fasten the pivot assembly in the receiving port.

20. The drain plug linkage device according to claim 14, wherein the first adjustment slider and the second adjustment slider are rotatably connected.

* * * * *